US005764264A

United States Patent [19]

Takanaka

[11] Patent Number: 5,764,264

[45] Date of Patent: Jun. 9, 1998

[54] IMAGE FORMING APPARATUS HAVING A MOVABLE SEPARATOR FOR SEPARATING A RECORDING MEDIUM FROM A FEEDING BELT

[75] Inventor: Yasuyuki Takanaka, Yokohama, Japan

[73] Assignee: Canon Kabushiki Kaisha, Tokyo, Japan

[21] Appl. No.: 505,146

[22] Filed: Jul. 21, 1995

[30] Foreign Application Priority Data

Jul. 21, 1994 [JP] Japan ..... 6-169500

[51] Int. Cl.[6] ..... B41J 2/01

[52] U.S. Cl. ..... 347/104; 341/101; 271/184; 271/225; 242/562

[58] Field of Search ..... 347/104; 318/632, 318/162; 101/115, 118, 123; 271/4, 7, 110, 113, 114, 256, 265, 266, 225, 184; 242/332.5, 332.6, 562, 615.2, 615.21; 226/191; 346/139 A, 136

[56] References Cited

U.S. PATENT DOCUMENTS

| | | | |
|---|---|---|---|
| 2,081,654 | 5/1937 | Wohlrabe | 271/2.6 |
| 4,296,365 | 10/1981 | Yoshikawa | 318/632 |
| 4,419,613 | 12/1983 | Ichinose et al. | 318/632 |
| 5,225,853 | 7/1993 | Kobayashi et al. . | |
| 5,345,863 | 9/1994 | Kurata et al. | 101/126 |
| 5,504,511 | 4/1996 | Nakajima et al. | 347/86 |

FOREIGN PATENT DOCUMENTS

| | | |
|---|---|---|
| 60-031728 | 7/1985 | Japan . |
| 5212851 | 8/1993 | Japan . |

*Primary Examiner*—N. Le
*Assistant Examiner*—Thien Than
*Attorney, Agent, or Firm*—Fitzpatrick, Cella, Harper & Scinto

[57] ABSTRACT

An image forming apparatus having a movable separator to separate a recording medium from a feeding belt includes feeding structure for feeding an attached recording medium in a predetermined feeding direction. Image forming structure receives the recording medium from the feeding structure and forms images on the received recording medium. The separator is located on a downstream side of the image forming structure, and separates the attached recording medium from the feeding structure in a direction which is angled from the predetermined feeding direction. The separator moves to push the recording medium from a non-recording face thereof to a recording face thereof while the recording medium is stopped during intermittent feeding to cause even separation of the recording medium from the feeding structure.

26 Claims, 21 Drawing Sheets

IMAGE FORMING APPARATUS HAVING A MOVABLE SEPARATOR FOR SEPARATING A RECORDING MEDIUM FROM A FEEDING BELT

BACKGROUND OF THE INVENTION

1. Field of the Invention

This invention relates to an image forming apparatus for feeding a recording medium made of fabric or paper which is continuously fed on feeding means by making it cling to the feeding means, and for separating the recording medium from the feeding means after forming an image on the recording medium.

2. Description of Related Art

Known image forming apparatuses such as screen printing machines or ink jet printing machines have been adapted to processes in which images are continuously recorded by intermittently feeding the recording medium by a predetermined length after each image for a portion of the predetermined length has been recorded on the halted recording medium.

For example, as disclosed in Japanese Patent Publication No. Showa 60-31,728 and Japanese Unexamined Patent Publication No. Heisei 5-212,851, such an image forming apparatus attaches a recording medium to a conveying belt of a feeding unit, separates the recording medium from the conveying belt at a separation zone located at the end of the feeding unit after the medium has passed through its image recording section, and feeds the recording medium to the subsequent process such as a rolling-up process using a delivery roll. Such an image forming apparatus can separate the recording medium without providing any specific member to actively pull off the recording medium from the feeding unit, since the recording medium is supplied in a continuous form, and since the conveying belt is wound so that the recording medium is guided with rollers or the like from the separation zone to the subsequent process.

More specifically, as shown in FIG. 20, a drive motor not shown gives a delivery roller 51 a certain torque for rolling up, so that the recording medium P with an image formed is separated from a conveying belt 52 at a separation position B located on a downstream side of a recording unit 53. While the recording medium P is stopped on the conveying belt 52, a recording head 53*a* of the recording unit 53 travels in the widthwise direction of the recording medium P to record an image of a constant length L. During this recording, the separation position B of the recording medium P, due to the torque for rolling up, slightly and gradually moves to a separation position B1 or toward the recording unit 53 on its upstream side, thereby rendering the conveyance route of the recording medium P shift to a position P'. Such a torque for rolling up for the delivery roller 51 is designed so that the distance between the position B and the position B1 becomes the same as the length L. A feeding unit 54 intermittently feeds the recording medium P by the length L upon completion of recording of the length L.

The feeding unit 54 intermittently feeds the recording medium P with high speed to make the time for non-printing shorter and increase the recording speed the of continuous image in total. The intermittent feeding speed is much higher than the separation speed of the medium during image recording, or the distance between B and B1 divided by recording time for the length L, and is usually one tenth of the recording time for the length L. Accordingly, while intermittently fed, the recording medium P is a little separated from the belt 52, so that the separation position B1 shifts to the separation position B. As a result, the recording medium P is intermittently separated with a constant interval, or the distance between B and B1, as equivalent to the length L.

With this image forming apparatus, however, the recording medium P has different times for clinging to the conveying belt 52 between the medium's separation stagnant portion and the medium's separation active portion. That is, since the recording medium P in the medium's separation active portion is gradually separated, the recording medium P in the medium's separation active portion is immediately separated from the conveying belt 52 when reaching the separation position, whereas the recording medium P in the medium's separation stagnant portion clings to the conveying belt 52 for a period as much as the recording medium P is intermittently being fed. Therefore, separation marks remain at boundaries between the active portion and the stagnant portion, because drying conditions of the recording medium after recording are so different between the active portion at which the medium has been already separated and the stagnant portion at which the medium is still clinging. If the image forming apparatus continuously records images, separation marks appear so as to form striped patterns 55 as shown in FIG. 21, thereby impairing image quality.

Although, to separate the recording medium P, the torque for rolling up is set so that the tension occurring in the recording medium P is substantially equal to or a little greater than the attaching force of the conveying belt 52, the attaching force tends to be deteriorated due to repeats of separations when the apparatus is used continuously. When the attaching force is deteriorated, the tension substantially surpasses the attaching force, so that the separation position advances closer to the recording unit 53, or on an upstream side, from the normal position in comparison with that before the attaching force is deteriorated. Consequently, the image recording face of the recording medium P may contact a frame 53*b* of the recording unit 53 prior to the intermittent feed, thereby impairing image quality due to medium's wear-out. Moreover, if separations occur in the recording unit 53, the recording medium P is floated at the unit and disturbs operation of the recording head 53*a*.

When a drier 55 is, as shown in FIG. 20, mounted at a position before the recording medium P is rolled up on the downstream side of the separation position B and when the drier 55 heats and dries the recording medium P with a constant temperature, the recording medium P comes close to the drier 55 if the separation advances, thereby producing drying irregularity, and as a result, impairing image quality due to irregularity of density or hue.

The separation may begin at which the maximum tension is applied, and a line at which the medium P separates from the belt may irregularly curve, where widthwise uneven tension is exerted to the recording medium P when the apparatus initially starts with changes of the recording medium's type such as thickness and fabric thereof. Irregular stripe patterns may occur on the recording medium P in such a case. If the separation advances locally due to the widthwise uneven tension, the image recording face may, as described above, contact other members, thereby impairing image quality.

In contrast, if the tension is substantially weaker than the attaching force of the conveying belt 52 at any portion, the separation tends to retard, and the roller of the feeding unit 54 may irregularly wind the recording medium P as shown by a separation position B2 in FIG. 20. In such a case, image quality may be impaired due to contacts and wear-out between image recording faces, and the image forming apparatus may be broken due to extraordinary winding of the recording medium P occurring at an inner part of the feeding unit 54. Moreover, since the distance between recording medium P and the drier 55 becomes larger, the image forming apparatus cannot adequately dry the recording medium P, and as a result, irregular density or hue may occur, thereby impairing image quality.

SUMMARY OF THE INVENTION

It is an object of the invention to provide an image forming apparatus preventing striped separation marks from occurring when a recording medium is separated from conveying means to record a high quality image.

It is another object of the invention to provide an image forming apparatus preventing the separation of the recording medium from excessively advancing toward an image forming means, preventing image quality from being impaired due to medium recording face contacts to other parts, and preventing the image forming means from improperly operating due to floating of the recording medium.

It is yet another object of the invention to provide an image forming apparatus preventing the image recording faces of the recording medium from contacting each other or wearing out due to retardation of separation of the recording medium and preventing the recording medium from being wound in conveying means.

It is a further object of the invention to provide an image forming apparatus keeping the distance of the recording medium to a drier constant notwithstanding advancement or retardation of the separation of the recording medium and preventing image quality from being impaired.

(1) A typical constitution of the image forming apparatus according to the invention, solving the problems in the conventional technology, applicable to embodiments described infra, includes winding means for winding up a recording medium supplied in a continuous form, feeding means for attaching the recording medium and feeding it in a predetermined direction, image forming means for forming images according to image information on the recording medium fed by the feeding means, and separating means, located on a downstream side of the image forming means, for separating the recording medium from the feeding means in a direction angled from the feeding direction of the feeding means by shifting the recording medium from the non-recording face side thereof to the recording face side thereof while the recording medium is stopped during intermittent feeding.

(2) The image forming apparatus may further include detecting means located on an upstream side of the feeding means for judging as to whether a separation position at which the recording medium separates from the feeding means is within a predetermined zone, and may control, according to the detected result of the detecting means, at least one drive of the winding means, the feeding means, and the separating means.

(3) The image forming apparatus may further include a guide member, arranged in the recording medium's feeding route provided for the winding means, for guiding the recording medium always in contact with a non-recording face of the recording medium by forming a constant plane, and drying means arranged in opposition to the plane for drying the recording medium.

According to the construction of (1), the separating means allows the recording medium to smoothly separate from the feeding means during the feeding period of the intermittent feeding, so that the recording medium is continuously separated while the image is recorded, or during a stop operation of the intermittent feeding, and while the image is recorded, or during a feeding operation of the intermittent feeding.

According to the construction of (2), the image forming apparatus can maintain the separation line of the recording medium within a proper zone using the detecting means, and can prevent the recording medium from contacting to or being wound by other members.

According to the construction of (3), the recording medium is evenly dried on the plane formed by the guide member through constant interval between the recording medium and the drying means.

BRIEF DESCRIPTION OF THE DRAWINGS

The above and other objects and features of the invention are apparent to those skilled in the art from the following preferred embodiments thereof when considered in conjunction with the accompanied drawings, in which.

DETAILED DESCRIPTION OF PREFERRED EMBODIMENTS

First Embodiment

Figure 1:
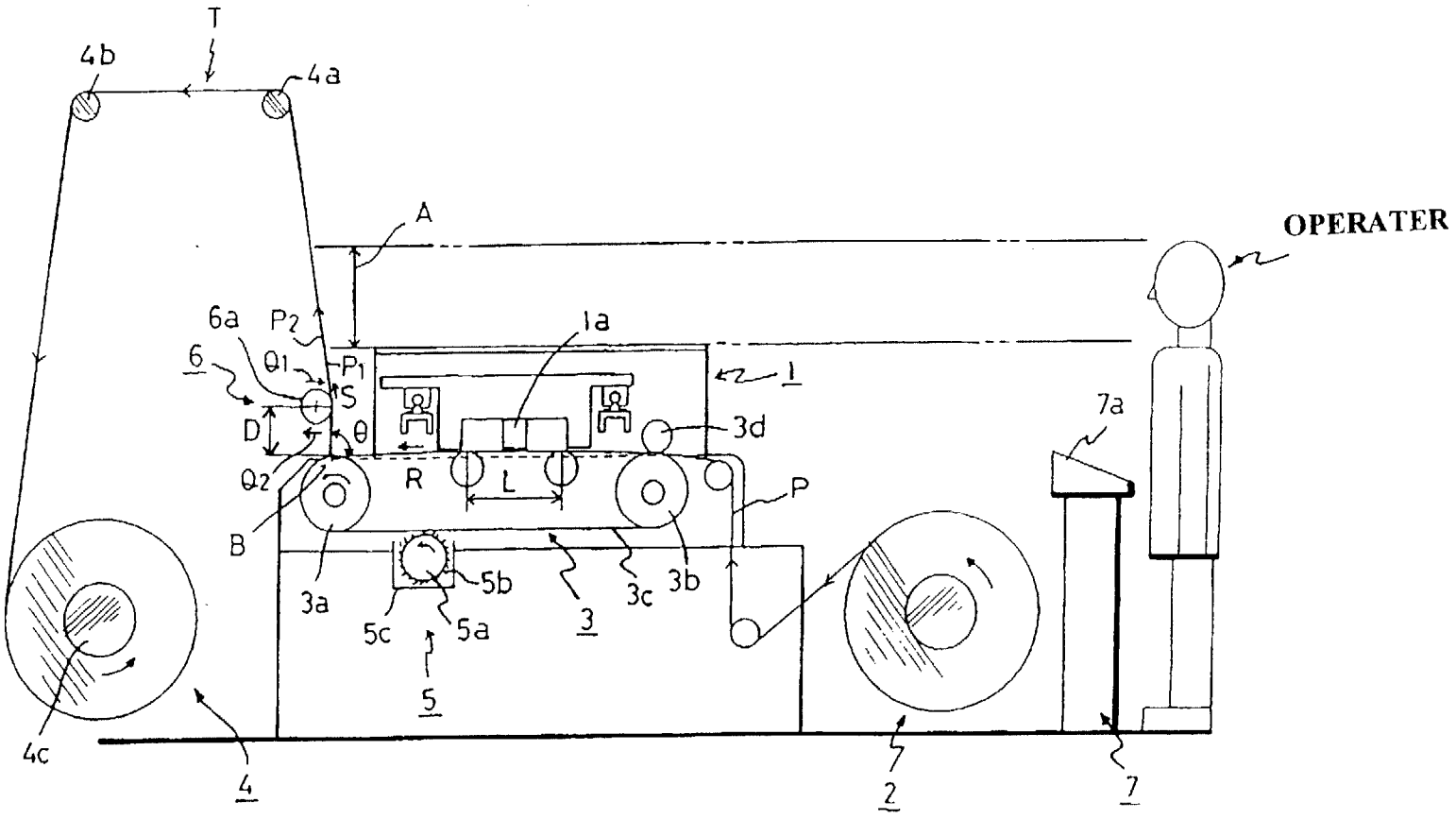
FIG. 1 is a cross-sectional illustration showing an image forming apparatus of a first preferred embodiment according to the invention.
Figure 2:
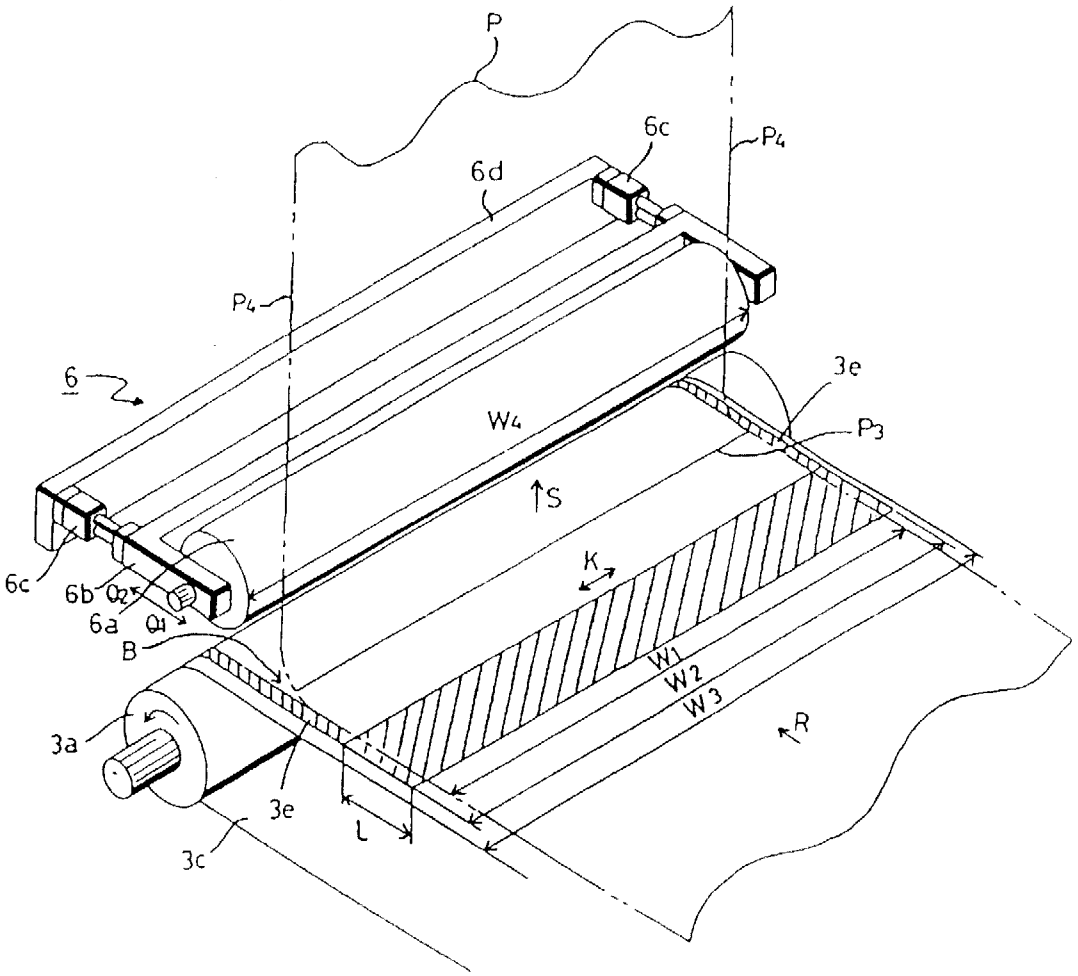
FIG. 2 is a perspective illustration showing a separation unit of the image forming apparatus shown in FIG. 1.

Referring to FIGS. 1, 2, an image forming apparatus according to a first preferred embodiment of the invention is shown. The numeral 1 represents a recording unit as image forming means, which is equipped with an ink jet recording head 1*a*. The recording head 1*a* records images on a recording medium P (or sheet P: such as cloth and paper) supplied in a continuous form, in a range of a predetermined length L (recording length) and a width W1 (=the width of the recording medium P). The image forming means of this apparatus adapts an ink jet recording method in which the recording head 1*a* discharges ink to make recording. That is, this recording head 1*a* includes fluid outlets (orifices) as very fine nozzles, fluid passages, energy operation portions provided at a part of the respective fluid passages, and energy generating means for generating droplet forming energy to operate to the fluid located at the energy operation portion.

As energy generating means for generating such energy, there are a recording method using an electric-mechanic converter such as a piezoelectric device, a recording method using energy generating means that heats ink by radiation of electromagnetic wave such as laser beam and discharges droplets by this heat operation, a recording method using energy generating means that heats fluid by an electrothermal converter such as a heating device having a heating resistor and discharges the fluid, and the like.

The recording head used for an ink jet recording method, among them, in which the thermal energy compels the fluid to be discharged, is capable of high resolution recording because the fluid outlets (orifices) for forming droplets to be discharged and discharging recording droplets can be arrayed with high density. The recording head, among them, in which the electric-thermal converter is used as the energy generating means, is readily made compact and has an advantage, because of sufficiently utilizing IC technology or micro fabrication technology accompanied with recent technological progresses in the art of semiconductor and significant improvements of reliability, easily being assembled with high density, and rendering manufacturing costs inexpensive.

The numeral 2 is a feeding unit roller for supplying the recording medium P given in a form of a roll. The numeral 3 is a feeding unit, as a feeding means, for feeding the recording medium P fed from the feeding unit 2. The feeding unit 3 has an endless conveying belt 3*c* coated with a sticking agent and tensioned between a drive roller 3*a* and a tension roller 3*b*. A clinging roller 3*d* in contact with the tension roller 3*b* with pressure attaches the recording medium P on the conveying belt 3*c*. The driven roller 3*a* is intermittently fed by the predetermined length L.

The numeral 4 represents a winding unit as winding means, and winds the recording medium P on which recording has been made, around a winding roller 4*c* by guide rollers 4*a*, 4*b*. The winding roller 4*c* is rotationally driven by a driven motor not shown and winds up the recording medium P.

The numeral 5 represents a cleaner for cleaning and rinsing the conveying belt 3*c*. The cleaner 5 removes dusts or the like clung onto the conveying belt 3*c* from fabric or paper used as the recording medium P and cleans the medium P.

The numeral 6 represents a separator, which pushes the recording medium P from a non-recording face side P2 toward a recording face side P1 and, at a separation position B on a downstream side of the recording unit 1, separates from the conveying belt 3*c* the recording medium P in an upper direction S angled q from a feeding direction R of the feeding unit 3.

The numeral 7 represents a control displaying respective operations of the image forming apparatus and being manipulated by operators with keys thereof. An operator can ordinarily pay attention to the respective operations of the image forming apparatus with a monitor 7*a* while standing near the control 7, and can observe the images formed on the recording medium P on which recording is made and which are brought into a watching zone A located over the recording unit 1 on a feeding route of the winding unit 4, to evaluate the images. In case that the operator identifies an unexpected image due to mistaken input of image data or defective recording due to malfunction of the recording head 1*a*, the operator can immediately stop the operation of the image forming apparatus by the control 7, and after giving proper adjustments, the operator can restart the ordinary image recording operation.

The apparatus cannot wind the recording medium P immediately after image recording because the ink does not adequately permeate into the recording medium P, so that the recording medium P is passed through a dry route T guided by the guide rollers 4*a*, 4*b* after being separated from the conveying belt 3*c* and then wound by the winding roller 4*c*. To realize both of such observation by operator's eyes and establishment of the dry route, the angle q of the recording medium P with respect to the separation position B is set in a range between 70° and 120°, and preferably, at 90°, in an apparatus in which images are recorded on a horizontal plane.

In the image forming apparatus, the recording head 1*a* reciprocally travels in K direction shown in FIG. 2, thereby recording images of a width L by a width W2 which is broader than the width W1 of the recording medium P. That is, a recording medium P such as fabric has its left and right sides P4 with indefinite wavy curving ends, so that it is difficult to assure its margins. Therefore, the apparatus records in excess of the width W1 of the recording medium P and never remains a non-recorded portion on the recording medium P. Notedly, the width W2 does not excessed the width W3 of the conveying belt 3*c* nor records images outside of the conveying belt 3*b* (W1 <W2<W3).

Thus, extraneously recorded portions 3*e* at which images are recorded extraneously outside the recording medium P are formed on the conveying belt 3*c*. When the recording medium P separates from the conveying belt 3*c*, dust coming out of the non-recording face side P2 or left and right sides P4 of the recording medium P, cling to sticky areas. The cleaner 5 removes and cleans and dusts the extraneously recorded portions 3*e*.

In the cleaner 5, as shown in FIG. 1, a brush 5*b* is formed around a cleaning roller 5*a*. The cleaning roller 5*a* is dipped in a bath 5*c* for storing cleaning liquid. The cleaning roller 5*a* is in contact with the conveying belt 3*c* and, while contacting it, cleans a face of the belt by being revolved in opposition to the belt proceeding direction. In particular, when a dispersion ink is used as ink, an anion related dispersant or a surface active agent, or a compound dispersing pigments, is used as the cleaning liquid.

Referring to FIGS. 1, 2, a detailed constitution of the separator 6 is described. The numeral 6*a* is a separation roller rotatably supported for pushing the recording medium P from the non-recording face side P2 to the recording face side P1. The numeral 6*b* is a supporting arm for supporting both ends of the separation roller 6*a*. The numeral 6*c* represents a cylinder for reciprocally moving the supporting arm 6*b* in arrow directions Q1, Q2 by pneumatic or hydraulic pressure. The numeral 6*d* is a plate for the cylinder 6*c*. Notedly, a mechanism in a which combination of a motor and a screw allows reciprocal movement, can be use in lieu of the cylinder 6*c*.

The separator 6 is as shown in FIG. 1 placed near to the separation position B; the separation roller 6*a* is in contact with the recording medium P on a downstream side of the separation position B by the distance D. As shown in FIG. 2, width W4 of the separation roller 6*a* is broader than the width W1 of the recording medium P, so that the separation roller 6*a* presses with the entire width the recording medium P.

In operation of the separator 6, the conveying belt 3c is stopped during image recording of the recording head 1a, and the recording medium P made to cling onto the conveying belt 3c is also stopped. The winding unit 4 applies a constant tension to the recording medium P by drive means such as a drive motor, not shown, or electromagnetic friction clutch. This tension is substantially necessary force to pull the recording medium P away from the sticking agent on the conveying belt 3c, and the separation speed is changeable according to the boundary condition between the sticking agent and the non-recording face P2 and according to the tension applied to the recording medium P.

The separation roller 6a travels in arrow Q1 direction by the cylinders 6c, 6c and pushes the recording medium P to separate it from the conveying belt 3c. The separation line P3 at which the recording medium P separates from the conveying belt 3c moves toward the recording unit 1 located on the upstream side thereof from the downstream side in the feeding direction of the recording medium P. The recording medium P separates from the belt by the separation roller 6a traveling in the arrow Q1 direction while ceasing to be fed intermittently.

When the recording head la finishes image recording of the length L, the drive motor, not shown, of the feeding unit 3 drives the drive roller 3a and intermittently feeds the recording medium P. At that time, the separation roller 6a travels in arrow Q2 direction while pushing the non-recording face P2. Although the separation line P3 moves toward the downstream side along with the recording medium that intermittently fed, the recording medium P is separated even during the feeding period of the intermittent feeding by controlling the traveling speed of the separation roller 6a to be a little slower than intermittent feeding speed.

The separation roller 6a placed near the separation position B guarantees continuous separation of the recording medium P. The separation roller 6a pushes the recording medium P within a range of distance D, which is better as shorter, and which begins from the separation position B. Therefore, the recording medium P takes little stretches across the width W1, thereby making the separation line straight, and thereby eliminating local advance and retardation of the separation. The separation roller 6a contacts the recording medium P with the non-recording face P2 thereof and is driven to revolve by the recording medium P conveyed for taking-up, so that the recording medium P remains free from being worn out at the non-recording face P2, from being napped when made of a fabric, and from being damaged. The recording medium P can be continuously conveyed without formation of stripe patterns as marks due to separation, and the image forming apparatus can smoothly separate the recording medium P from the conveying belt 3c, thereby recording images with high quality.

Notedly, the drive of the winding roller 4c can be controlled in various ways. That is, the winding roller 4c may be rotated with a taking-up speed more than the feeding speed of the feeding unit to give a tension to the recording medium P. The winding roller 4c may be stopped or rotated with slower speed while the feeding unit 3 feeds the recording medium P, to let the feeding unit 3 do separation work by its feeding movements. When the winding roller 4c is rotated with slower speed, the separator 6 can be synchronized with the roller 4c to eliminate the recording medium P from flagging.

Modifications of Separator

Figure 3:
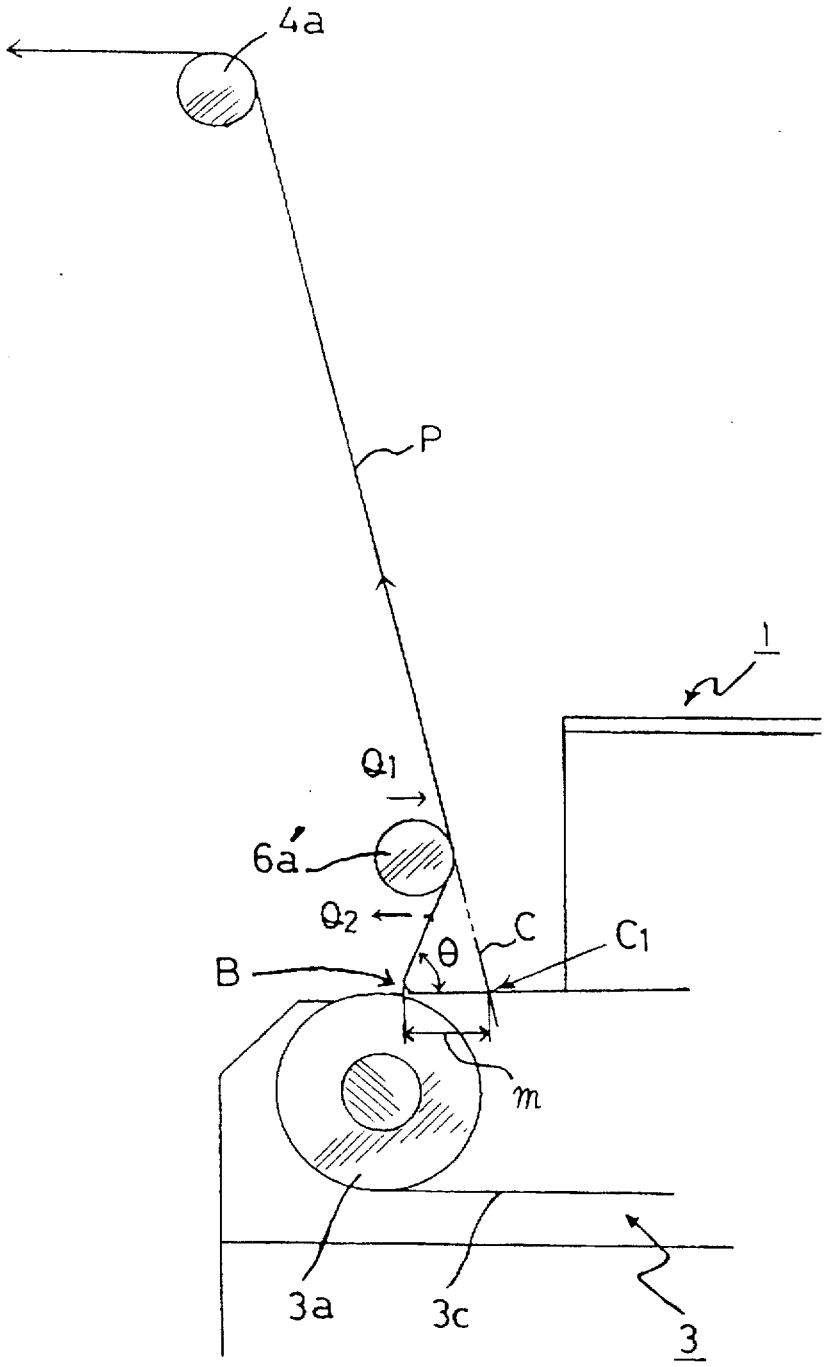
FIGS. 3 to 5 are illustrations showing other modifications, respectively, of the separation unit.
Figure 4:
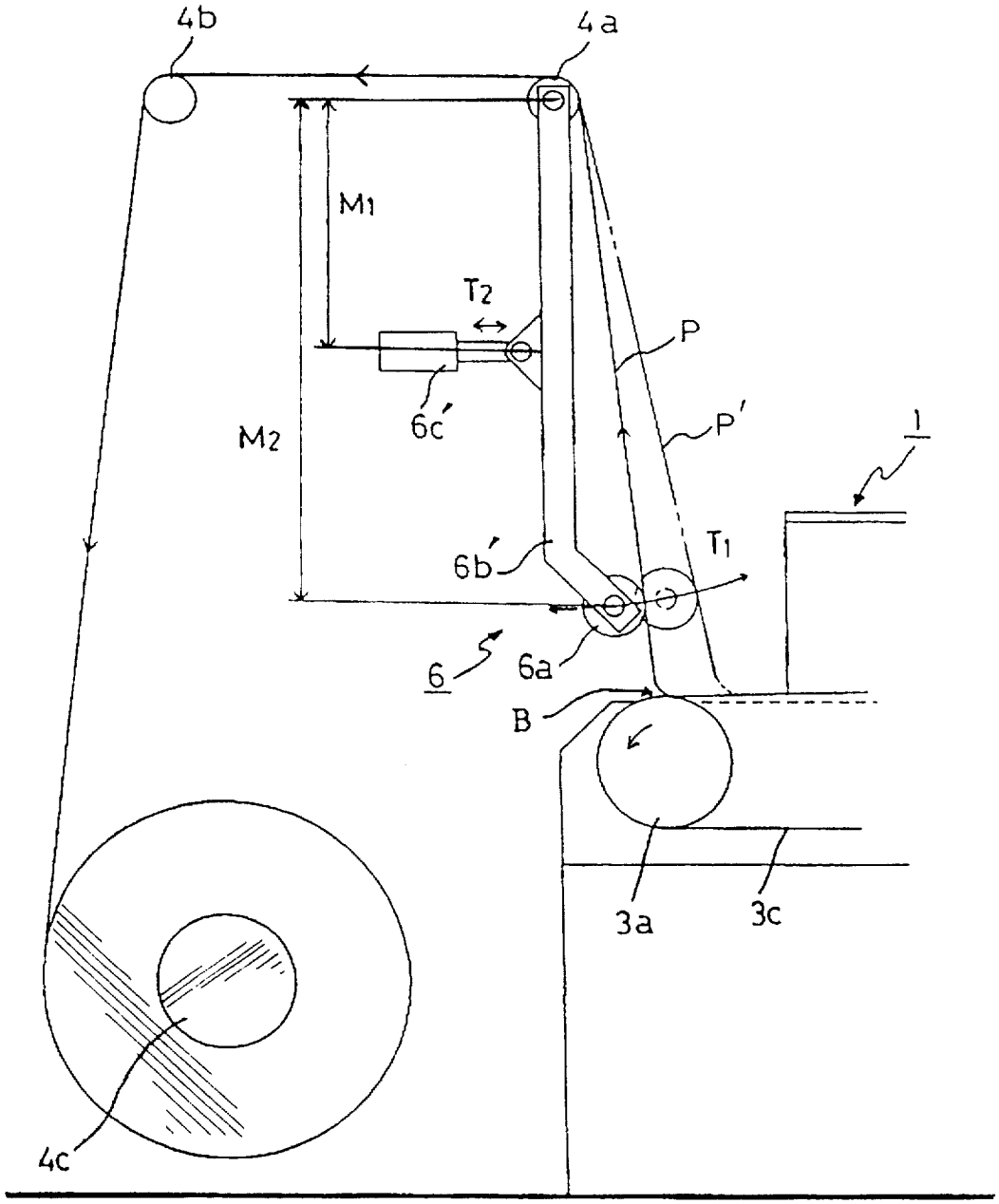
Figure 5:
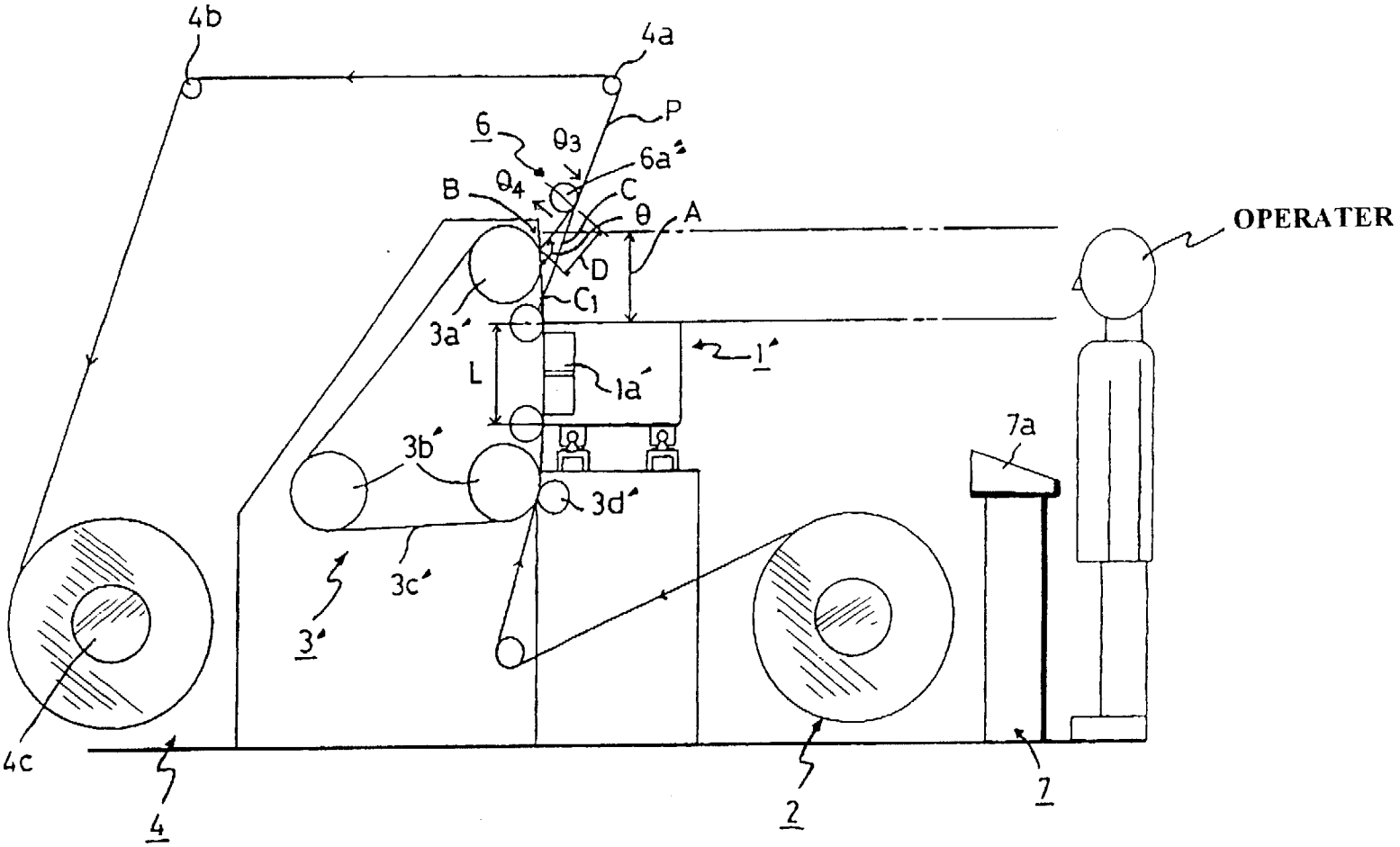

Referring to FIGS. 3 to 5, modified separators are shown. In FIG. 3, the separation roller 6a' is placed so that the separation position B is located on a downstream side in a feeding direction of a virtual plane as a downward extension of a plane commonly contacting with the guide roller 4a and the separation roller 6a'. The separation roller 6a' operates in the same manner as the separation roller 6a' above. The separation roller 6a' stops while the feeding unit ceases to intermittently feed the recording medium P, and therefore, the recording medium P is separated by the tension given by the winding roller 4c. The separation of the recording medium P may advance within a section m from the separation position B to a cross line C1 intersecting the virtual plane C with the conveying belt 3c. The cross line C1 is designed not to reach the recording unit 1.

When the feeding unit 3 feeds the recording medium P intermittently, the separation roller 6a travels in the arrow Q1 direction by a half of period that is required for one cycle of intermittent feeding and travels in the arrow Q2 direction by the remaining half to return to the original position. By such operation of the separation roller 6a', the recording medium P is separated even during the feeding period of the intermittent feeding, as well as during the stop period of the intermittent feeding, so that the recording medium P is continuously separated from the conveying belt 3c and is allowed to be with high quality recorded without being formed with stripe patterns due to marks of separation. Since the separation roller 6a' is traveled only during the feeding period of the intermittent feeding, this apparatus can reduce the operation time of the drive mechanism such as cylinders 6c, 6c or the like, thereby enabling its life span to extend.

Referring to FIG. 4, another constitution of the separator 6 is shown. A supporting arm 6b' is rotatably supported by a shaft of the guide roller 4a at one end thereof and supports the separation roller 6a at the other end thereof so that the separation roller 6a can rotate. A cylinder 6c' is connected at the center of the supporting arm 6b', or at a position distance M1 away from the guide roller 4a. Where the distance between the guide roller 4a and the separation roller 6a is M2, the stroke of the separation roller 6a in arrow T1 direction is calculated by the stroke of the cylinder 6c' in the arrow T1 direction multiplied by M2/M1, so that the cylinder 6c', even if having a small stroke, obtains necessary movement amount to separate the recording medium P from the conveying belt 3c.

FIG. 5 shows a modification when the feeding route of the recording medium P is different. The recording medium P is attached onto a conveying belt 3c' by a clinging roller 3d' at the lower side of the feeding unit 3' and is recorded by a recording head 1a' in an area of length L. The recording medium P is separated from the conveying belt 3c' at the separation position B and is wound by the winding roller 4c after passing through the guide rollers 4a, 4b.

A separation roller 6a" is arranged over a drive roller 3a', or at a downstream position of the separation position B by distance D, and pushes the recording medium P from the non-recording face side P2 of the medium. The separation roller 6a' does not move during image recording, or during the stop period of intermittent feeding, and the winding roller 4c provides tension to separate the recording medium P from the conveying belt 3c'. The separation roller 6a" then moves in arrow Q3 direction during the feeding period of the intermittent feeding to separate the recording medium P. As well as the modification shown in FIG. 3, the separation position B is placed on a downstream side of the cross line C1 at which the virtual plane C and the conveying belt 3c' intersect with each other. The separation roller 6a" moves in the arrow Q3 direction in the first half of the intermittent feeding period and in the arrow Q4 direction in the second half.

The same effects as the modification shown in FIG. 3 can be obtained in this modification in which the recording medium P is conveyed through the feeding route constituting an upright proceeding face to record images.

Notedly, a member having low resistance against friction and high sliding-ability, such as a fixed guide plate or like on the surface of which fluororesin is coated, in lieu of the separation rollers 6a, 6a', 6a", allows the apparatus to obtain the same effects.

Second Embodiment

Figure 6:
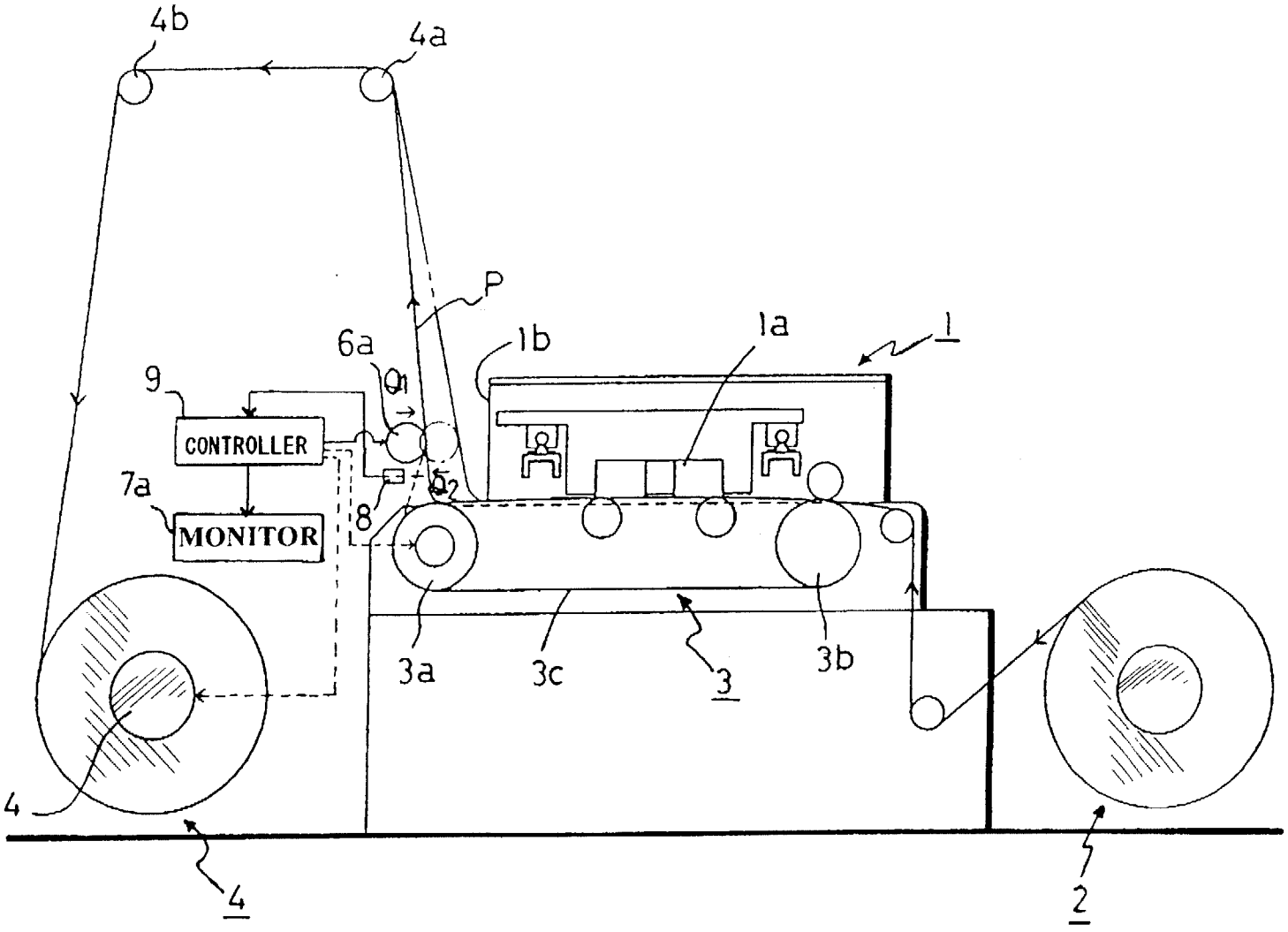
FIG. 6 is a cross-sectional illustration showing an image forming apparatus of a second preferred embodiment according to the invention.
Figure 7:
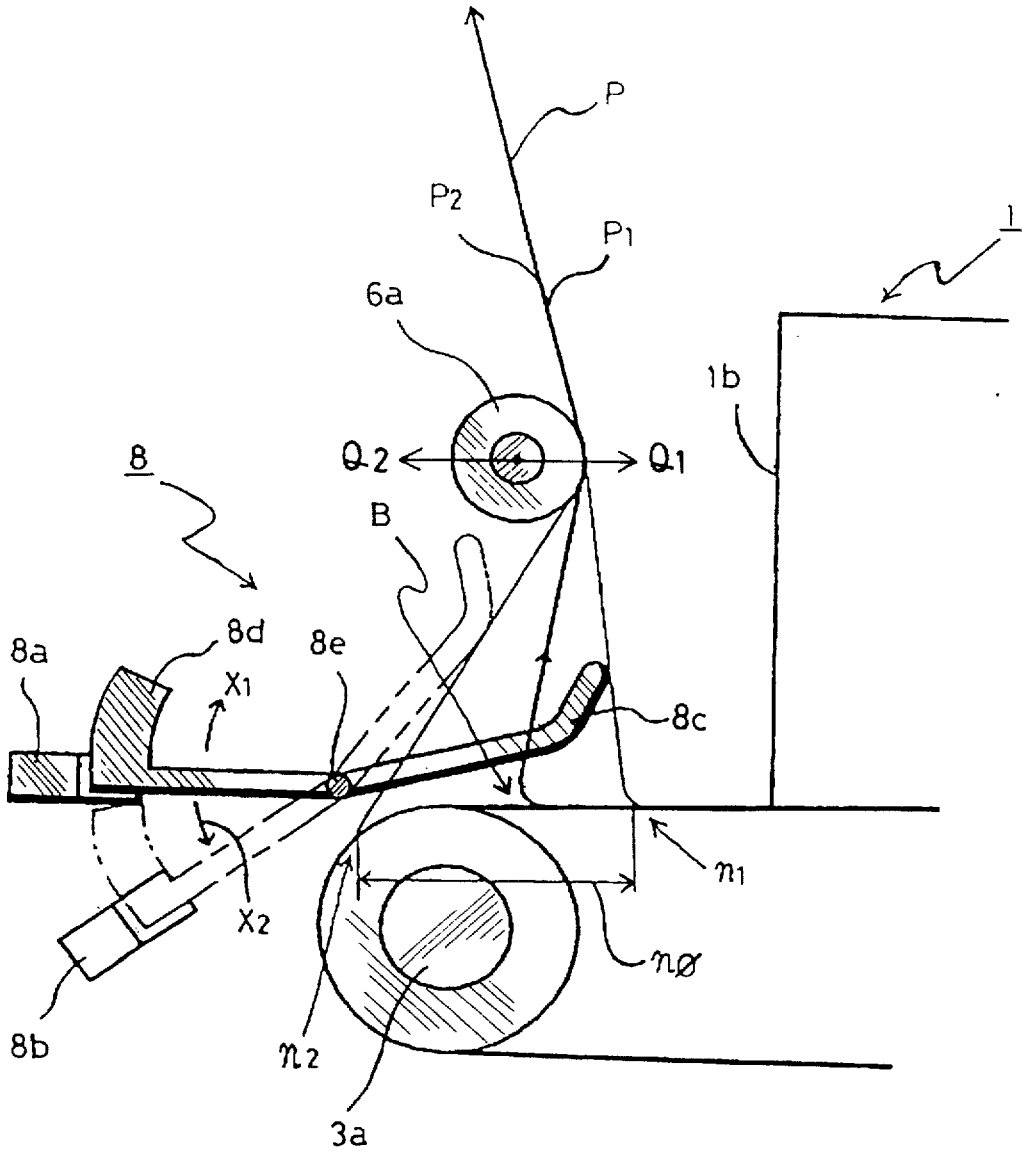
FIG. 7 is an illustration showing a sensor unit of the image forming apparatus shown in FIG. 6.

Referring to FIGS. 6,7, another embodiment of the image forming apparatus is shown. Duplicated description is omitted for the sake of simplicity, while the same member is given to the same reference number as in the embodiment above.

In FIG. 6, a sensor 8 constituted of a non-contact disposition meter or whatever is arranged, as detecting means for detecting a position at which the recording medium P separates from the feeding unit 3, on the upstream side of the separation roller 6a. The sensor 8 transmits the signals to a controller 9, which sends drive control signals to cylinders 6c for reciprocally moving the separation roller 6a, to a drive motor, not shown, for driving the drive roller 3a in the feeding unit 3, and to a drive motor, not shown, for driving the winding roller 4c in the winding unit 4, respectively, thereby controlling the respective drives of those drive sources. As the control method of those drive sources, the image forming apparatus uses control of drive torque, control of feeding speed of the recording medium P, and control of reciprocal movement speed and stroke of the cylinders 6c.

As shown in FIG. 7, the sensor 8 includes a detection lever 8c urged so as to contact to the non-recording face P2 of the recording medium P, photointerrupters 8a, 8b serving as optical sensors, and a photo-shield plate 8d. The detection level 8c swings together with the photo-shield plate 8d in up and down directions around a shaft 8e as the center thereof which is fixed to a side board or whatever.

For the purpose of this description, the area at which the recording medium P separates normally is defined as zone n0; an upstream limitation at which the separation position B becomes out of the zone n0 and comes close to a supporting member 1b of the recording unit 1 located on an upstream side thereof, is defined as position n1; and a downstream limitation at which the recording medium P might be wound by the drive roller 3a located on the downstream side thereof, is defined as position n2. If the separation position B is located within the zone n0, the photo-shield plate 8d on the detection lever 8c prevents only the photointerrupter 8a from receiving light. If the separation position B reaches the upstream limitation position n1, the photo-shield plate 8d swings in arrow X1 direction, thereby allowing both of the photointerrupters 8a, 8b to receive light. In contrast, if the separation position B reaches the downstream limitation position n2, the photo-shield plate 8d swings in arrow X2 direction, thereby preventing only the photointerrupter 8b from receiving light. The image forming apparatus thus detects separation position B according to the advance or retreat of separation by the output signals from the photointerrupters 8a, 8b.

In operation, if the separation position B is located within the zone n0, the separation roller 6a is reciprocally moved in arrow Q1, Q2 directions as shown in FIG. 7, and the apparatus repeatedly performs normal image recording operation (during the stop period of intermittent feeding) and feeding operation of the intermittent feeding. If the separation position B reaches, for example, the upper limitation position n1 while the separation roller 6a travels in the arrow Q1 direction, the controller 9 temporarily stops the separation roller 6a from traveling at the position. If the separation position B then comes within the zone n0, the apparatus continuously records the image again. On the other hand, if the separation position B does not come within the zone n0, the apparatus immediately displays a separation advance sign on the monitor 7a the control 7, and continues stopping of drive of the apparatus. In such a case, the apparatus takes any one of controls of: 1) reducing the drive torque of the winding roller 4c; 2) reducing the traveling speed of the separation roller 6a in the arrow Q1 direction; and 3) reducing the stroke of the separation roller 6a in the arrow Q1 direction, to change its set values. The apparatus, as the well as above controls, may detect the separation position B, as an operation after the separation position B has reached the upstream limitation position n1, by stepwise reducing the drive torque of the winding roller 4c according to signals from the control. If the controller 9 judges that the separation position B is advancing, the apparatus takes controls of 2) or 3). In case that the separation position B continues to advance even though the apparatus has controlled or reset such parameters several times, the controller judges that the adhesive has been deteriorated or dropped, and the adhesive is replaced or new adhesive is overcoated.

If the separation position B reaches the downstream limitation position n2, the apparatus takes any one or more of controls of: 1) increasing the traveling speed of the separation roller 6a in the arrow Q1 direction; 2) increasing the stroke of the separation roller 6a in the arrow Q1 direction; 3) reducing the traveling speed of the separation roller 6a in the arrow Q2 direction; 4) reducing the stroke of the separation roller 6a in the arrow Q2 direction; 5) increasing the drive torque of the winding roller 4c; 6) increasing the winding speed of the winding roller 4c; and 7) reducing the feeding speed of the conveying belt 3c.

If a situation that the separation position B is at the downstream limitation position n2 continues for a certain period or more, the controller 9 judges that the separation is retarding and performs displaying to the monitor 9 and stopping the drives of the apparatus. In case that the controller 9 judges that the separation is retarding even upon controls of the control of 1~7, the recording medium P is never separated by the separator 6 or the winding unit 4, and therefore, the operator checks the apparatus since the recording medium P has possibly jammed at the feeding unit 3 or the conveying belt 3c. After removing problem portions, the operator restarts the operation of the image forming apparatus.

The image forming apparatus can keep the recording medium P in a proper range of the separation position by controlling the drives of the feeding unit 3, the winding unit 4, and the separator 6. The image forming apparatus can efficiently record images by automatically eliminating extraordinary separations and by allowing the operator to check the apparatus while the operation is stopped if the separation position goes beyond positional limitations. Accordingly, the image forming apparatus can record images with high quality and without reducing operating rate thereof.

Other Modifications

Referring to FIGS. 8 to 15, other constitutions of the sensor 8 shown in the second embodiment are shown.

Figure 8:
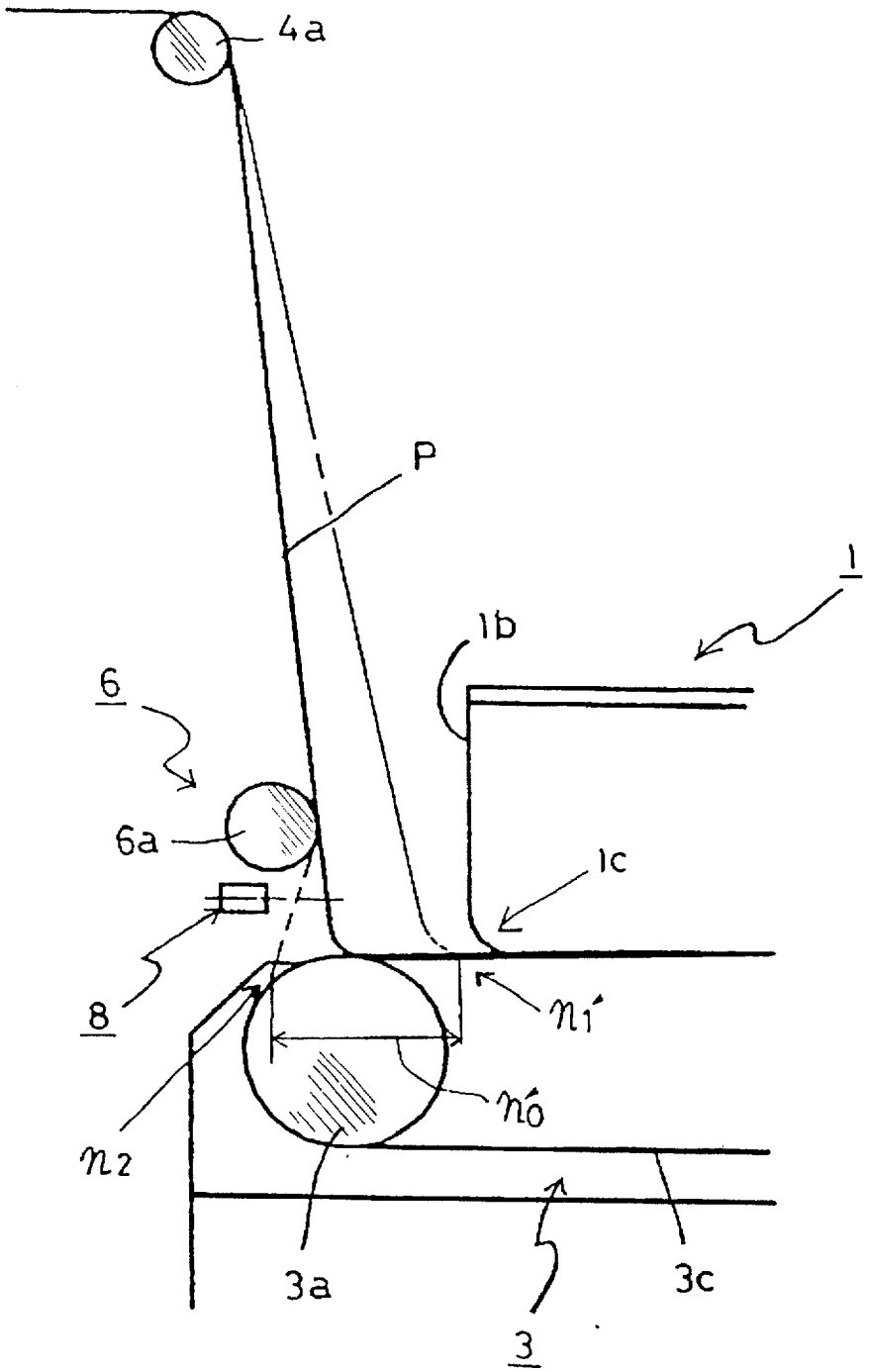
FIGS. 8 to 13 are illustrations showing other modifications, respectively, of the sensor unit shown in FIG. 7.

A corner 1c, located facing the conveying belt 3c, of the supporting member 1b of the recording unit 1 is rounded or chamfered as shown in FIG. 8. The upstream limitation position n1' can be set at side higher than above by thus forming the corner 1c, and as a result, the apparatus can take a wider zone n0' in which the separation can be done properly. This arrangement of the corner 1c allows the controls of the respective drive means by the controller 9 to be less sensitive, and therefore, the apparatus can set response and accuracy of the mechanism thereof in less restricted ways.

Figure 9:
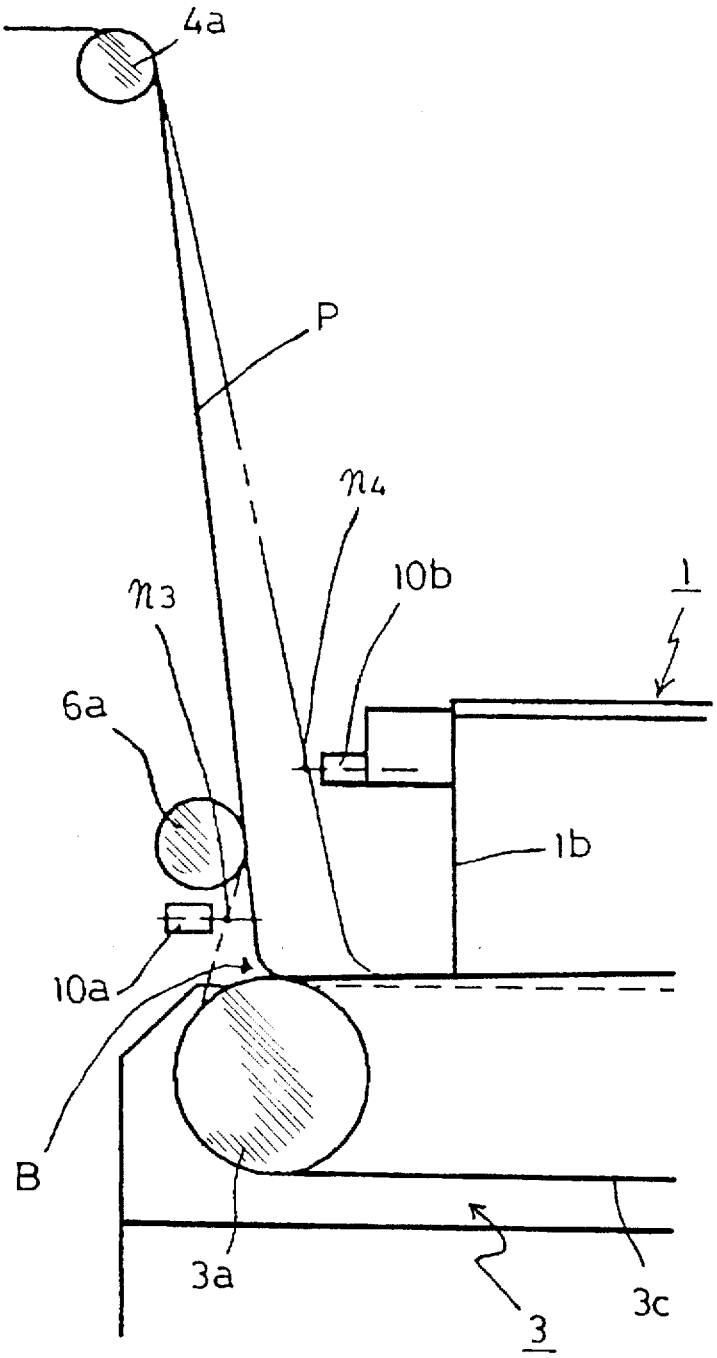

Referring to FIG. 9, the numeral 10a is a distance sensor secured on the non-recording face P2 on the upstream side of the separation roller 6a. The distance sensor 10a detects distance n3 between itself and the recording medium P. As the distance sensor 10a, a contact type differential micro switch, a combination of the detection lever and photointerrupters, a reflection sensor, optical or acoustic, as of a non-contact type, or the like is used.

The numeral 10b is another distance sensor arranged on the supporting member 1b of the recording unit 1 on the recording face P1 side of the recording medium P on a downstream side of the separation roller 6a to detect distance n4 between itself and the recording medium P. The distance sensor 10b is composed of a non-contact type reflection sensor as described above because it is disposed on the side of recording face P1 of the medium. The controller 9 controls the respective drives of the drive sources of the feeding unit 3 based on the detection signals of the detection sensor 10a, 10b.

Figure 10:
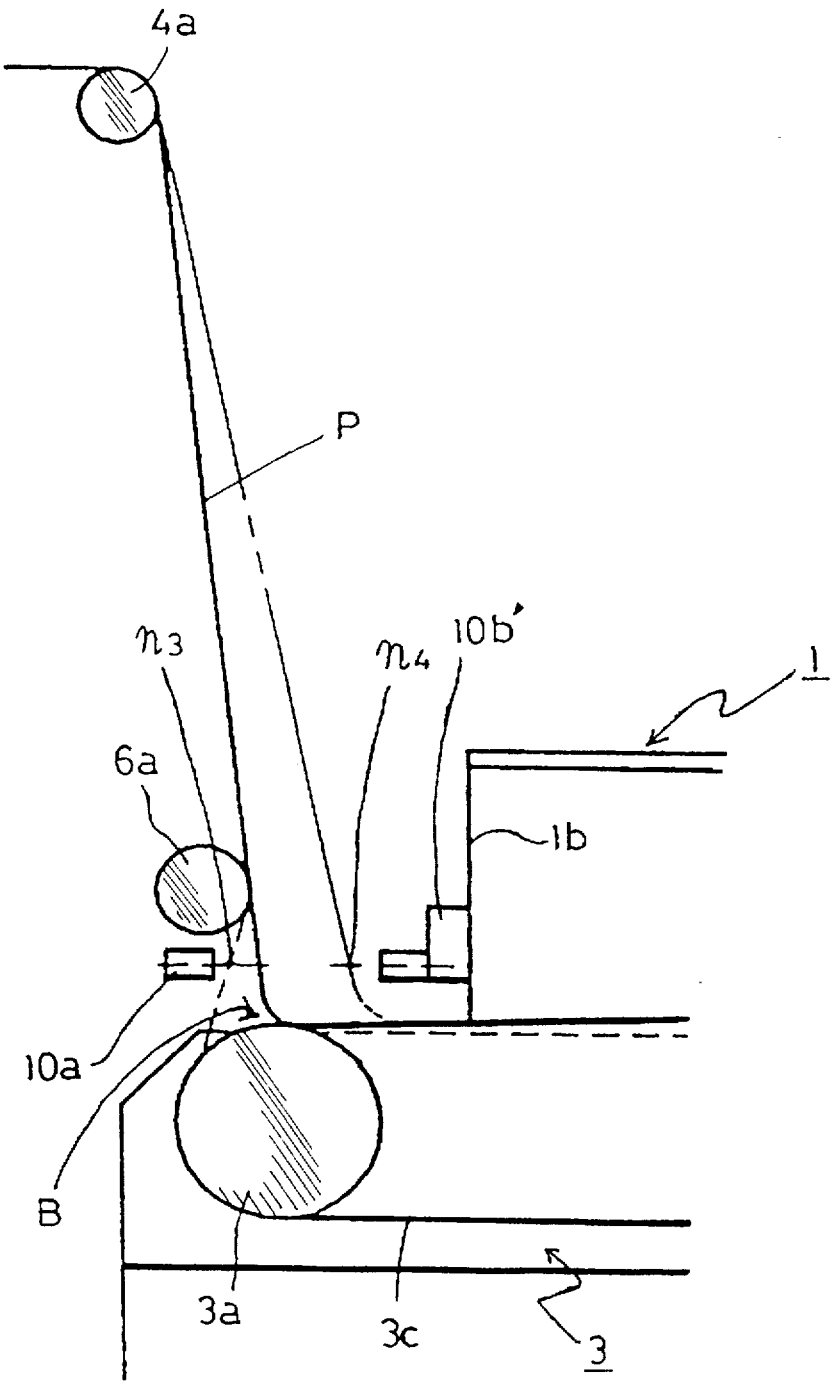

The distance n3 is for detecting separation retardation; the distance n4 is for detecting separation advancement. The controller 9 controls the drives of the drive sources of the feeding unit 3 and the separator 6 so that the recording medium P is passing at a position where the distance sensor 10a detects the distance n3 or more and where the distance sensor 10b detects the distance n4 or more. In FIG. 10, such a distance sensor 10b' is disposed on the upstream side of the separation roller 6a. Other constitution and control of the apparatus in FIG. 10 is the same as above.

Figure 11:
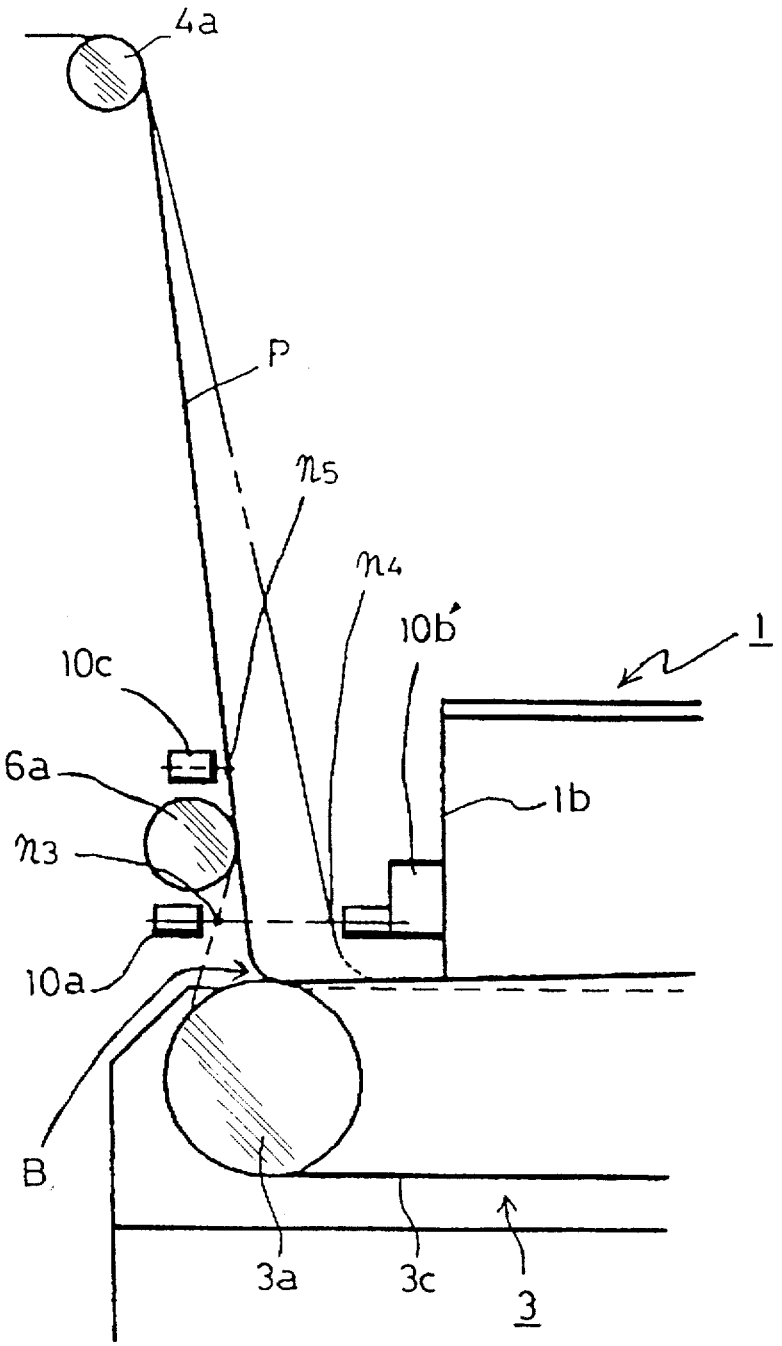

In FIG. 11, another distance sensor 10c, in addition to the sensor 10b' shown in FIG. 10, is provided on the non-recording face P2 side on the downstream side of the separation roller 6a along with the separation roller 6a. The distance sensor 10c is composed of a sensor of the same type as of the distance sensor 10a to detect distance n5 between itself and the recording medium P. The distance n5 is for detecting contact between the separation roller 6a and the recording medium P. According to this constitution, the apparatus can control the separation roller 6a to contact with the recording medium P without separating for a certain period or more.

Figure 12:
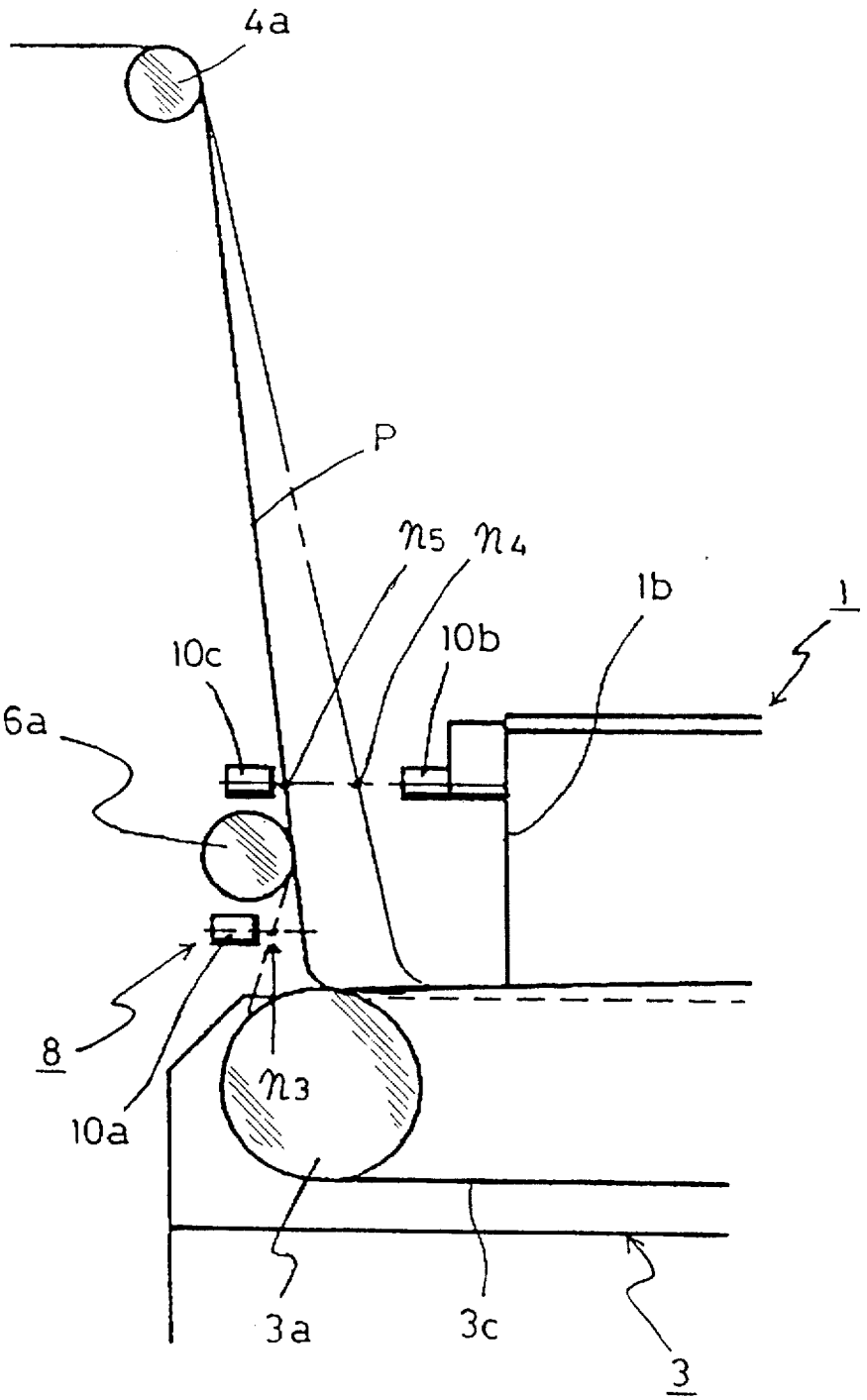

In FIG. 12, the distance sensor 10c is provided on the non-recording face P2 side on the downstream side of the separation roller 6a along with the separation roller 6a, in addition to the distance sensors 10a, 10b shown in FIG. 9. The apparatus with this sensor arrangement operates, is controlled, and has the effects, as well as the apparatus shown in FIG. 11. Location and assembly of the distance sensor 10b in FIGS. 9 to 12 can be chosen in consideration of conveniences when the apparatus is designed.

Figure 13:
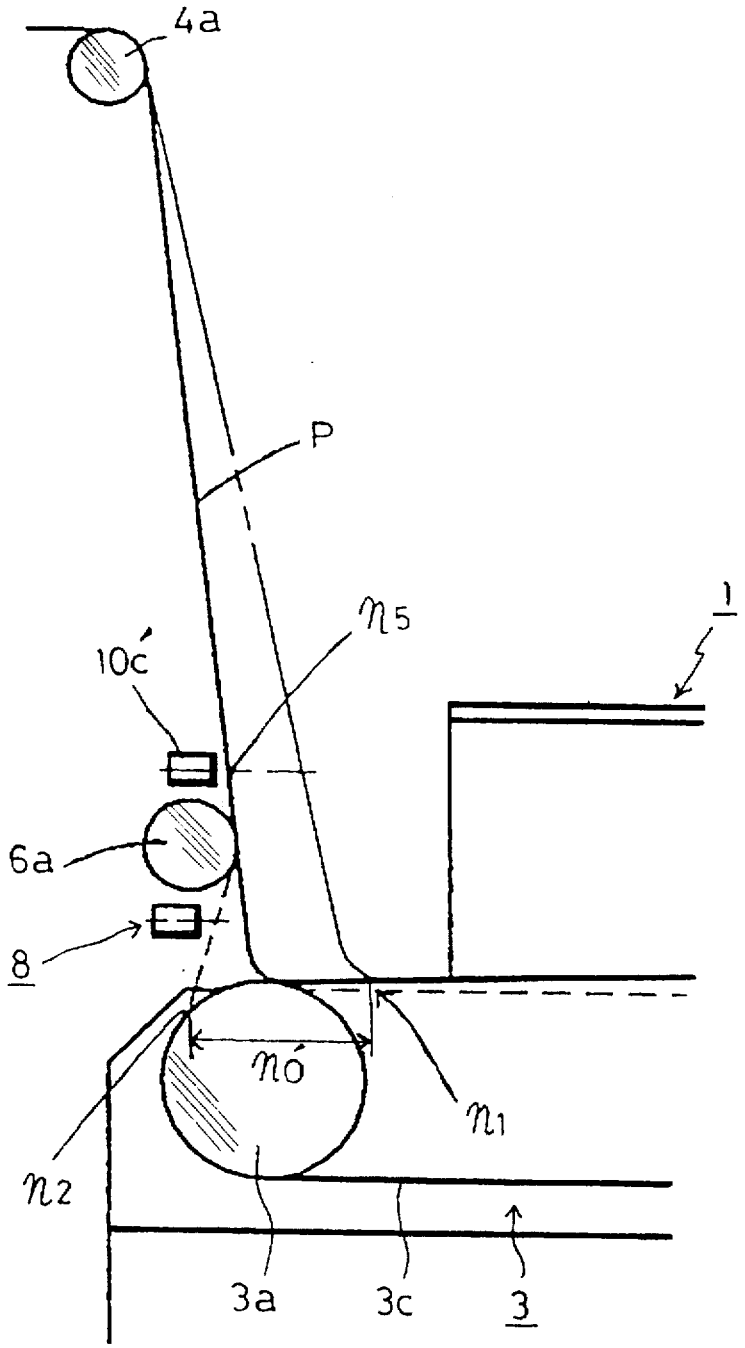
Figure 14:
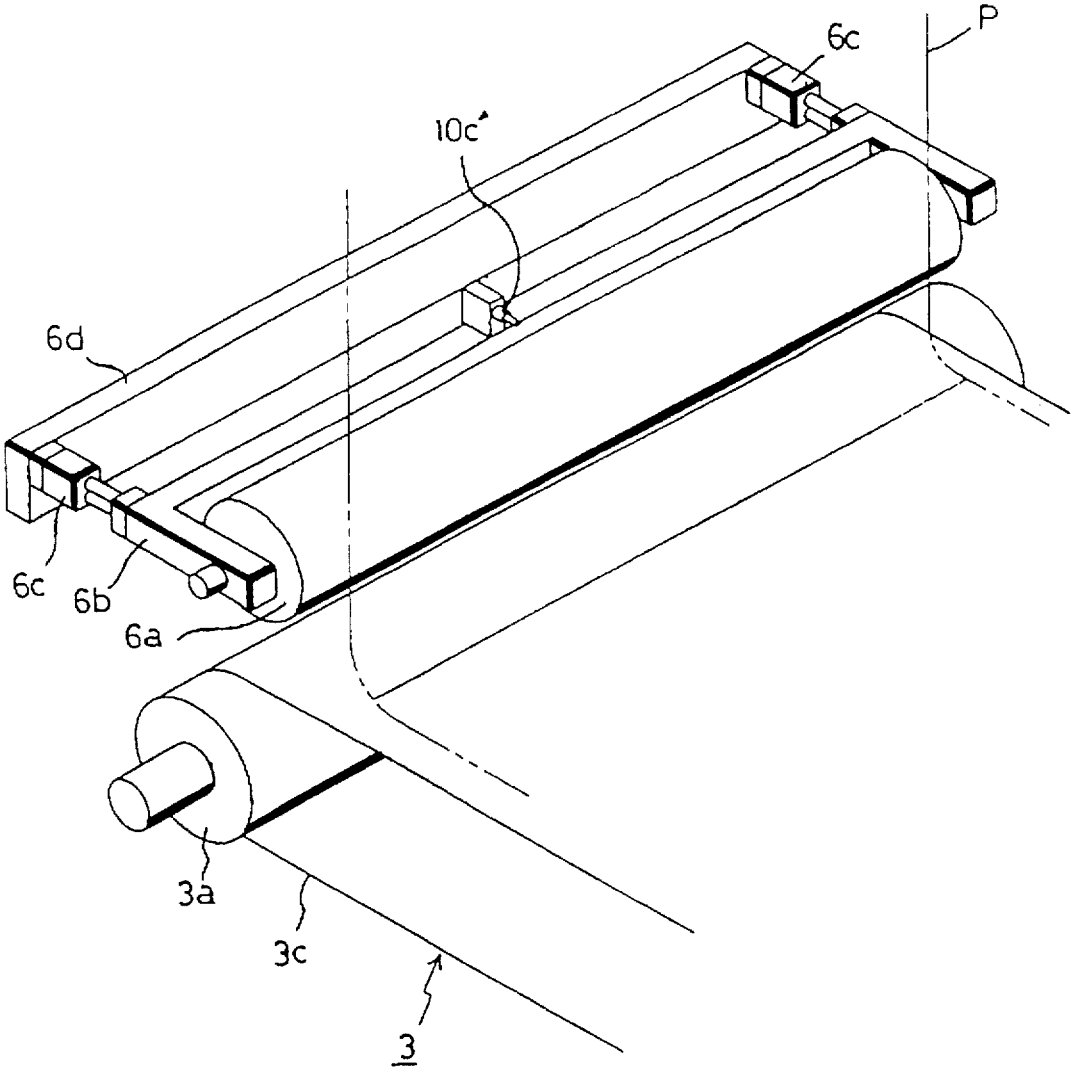
FIGS. 14, 15 are perspective illustrations showing other modified positions of the sensor unit.

In FIG. 13, a distance sensor 10c', in addition to the sensor arrangement shown in FIG. 9, is provided on the non-recording face P2 side on the downstream side of the separation roller 6a along with the separation roller 6a. The distance sensor 10c' is composed of a sensor of the same type as of the distance sensor 10a to detect distance n5 between itself and the recording medium P. The distance sensor 10c' can be formed on the supporting arm 6b as shown in FIG. 14, so that the distance sensor 10c' and the separation roller 6a are able to reciprocally move together.

Figure 15:
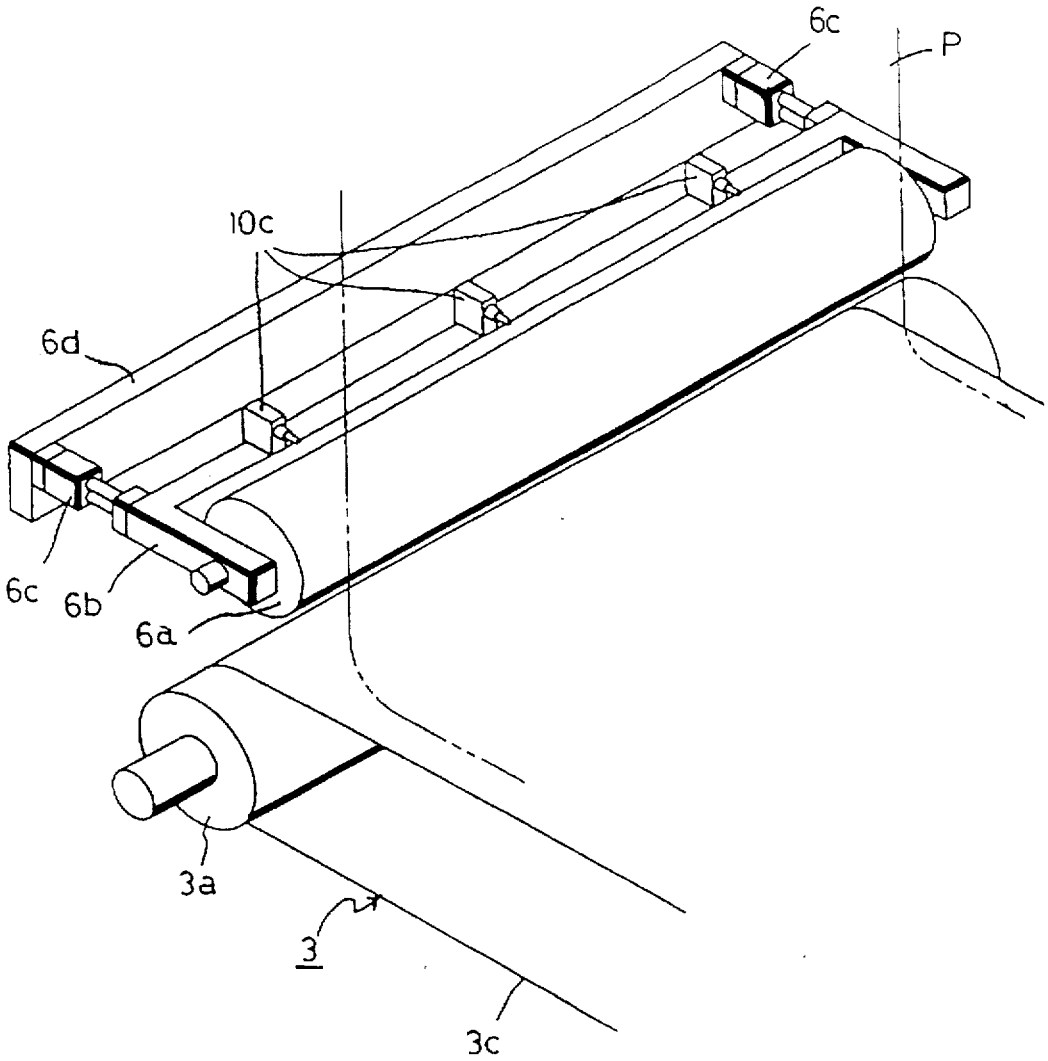

Notedly, each of the sensor 8 and the distance sensors 10a, 10b (10b'), and 10c (10c') is not necessary to be a single sensor. For example, as shown in FIG. 15, the distance sensor 10c can be composed of plural sensors located at left end, center, right end in the width direction of the recording medium P. Such plural sensors are capable of detecting irregular separation in the width direction. Such irregular separation may occur right after the apparatus starts to operate or when clinging force locally deviates due to irregularity in the width direction of the recording medium P, of attaching pressure of the clinging roller 3d. The apparatus, even when such irregular separation occurs, can detect portions at which separation advance or retreat occurs in an early stage, and can control or set the drive sources again.

Figure 16:
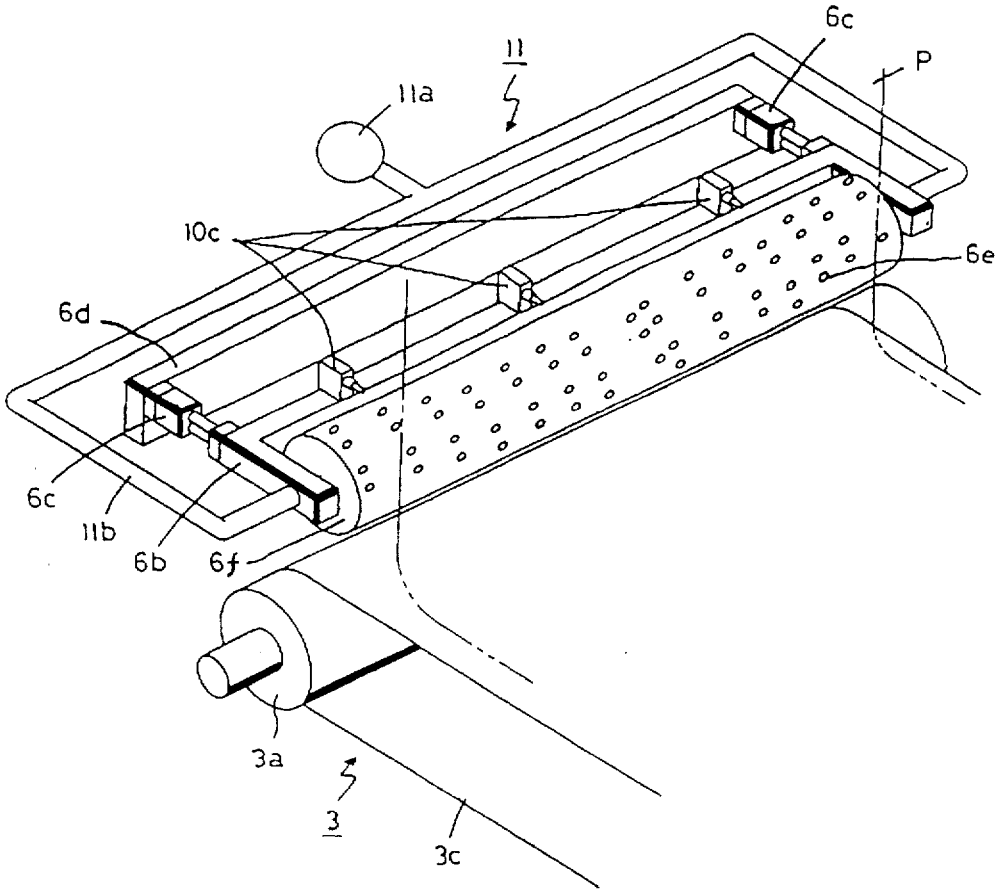
FIG. 16 is an illustration showing a modification of the separation roller of the image forming apparatus shown in FIG. 6.

In FIG. 16, a modified apparatus has a separation roller 6f with a suction system 11. The separation roller 6f is formed with plural holes 6e on its round surface and is connected to a pipe 11b at its both ends. The pipe 11b is connected to a suction pump 11a. When the suction pump 11a operates, the separation roller 6f sucks the recording medium P on its round surface, thereby preventing the recording medium P from being away from the roller . The apparatus ensures, by the suction system 11 thus constituted, that the separation roller 6f contacts the recording medium P without separation advanced and that the recording medium P separates from conveying belt 3c.

Figure 17:
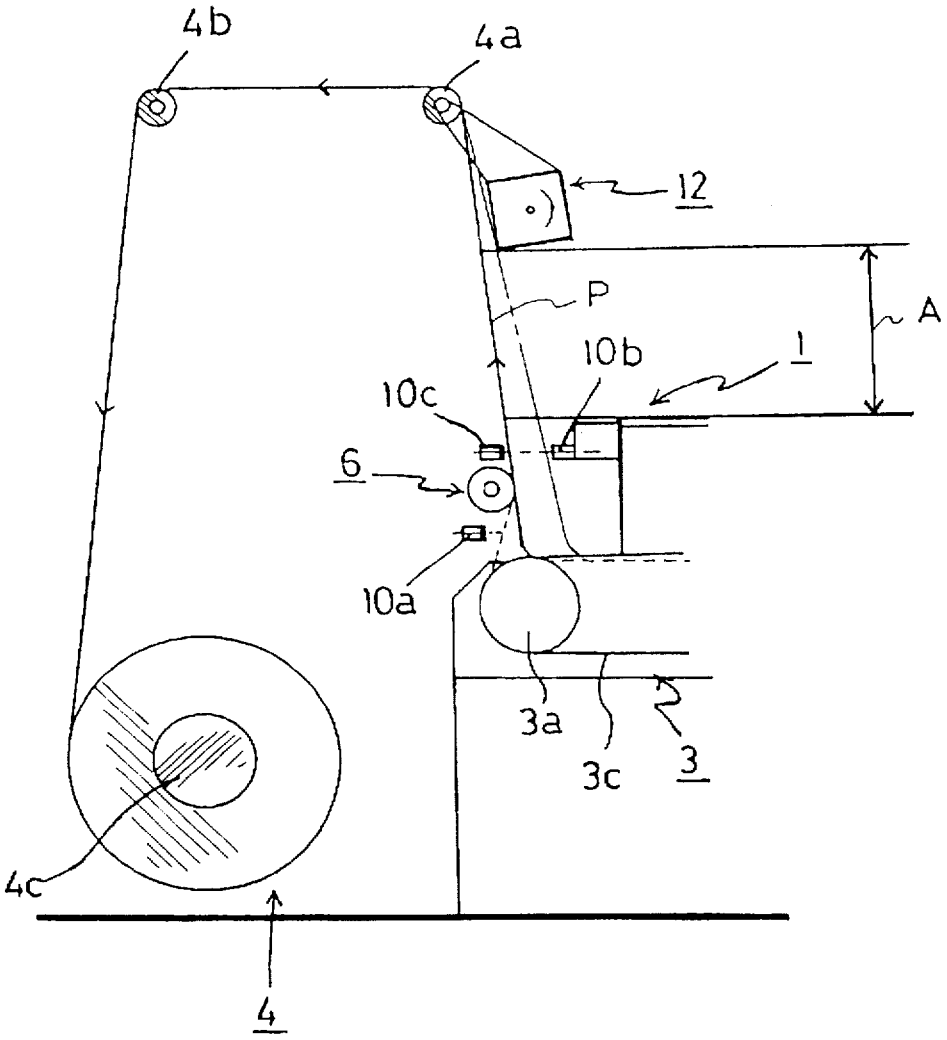
FIGS. 17, 18 are illustrations showing other modifications, respectively, of the drier of the image forming apparatus shown in FIG. 6.
Figure 18:
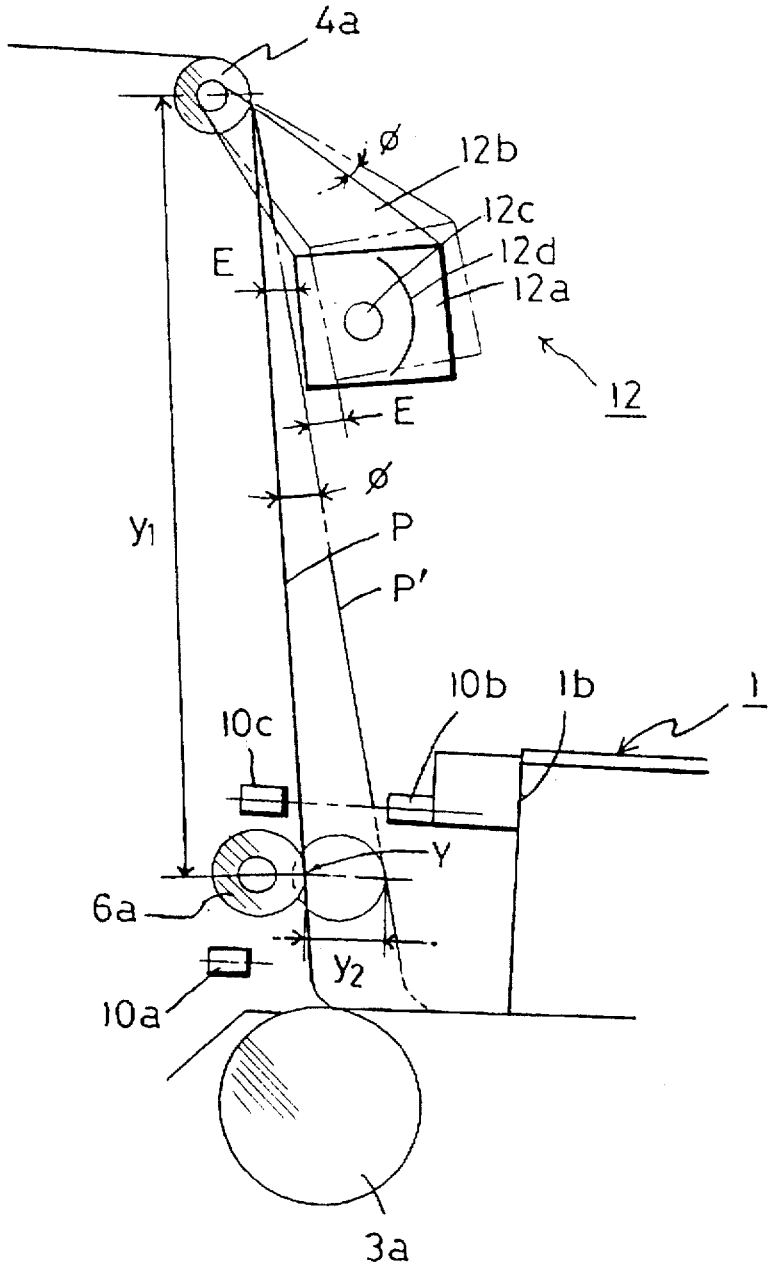

In FIGS. 17, 18, a modified apparatus has a dryer 12 disposed on the downstream side of the separator 6. The numeral 12a represents a heater serving as a thermal source; the numeral 12b represents a supporting plate swingably attached to the guide roller 4a for supporting the heater 12a. The dryer 12 swingably moves around the guide roller 4a as the center thereof by means of such as a motor or cylinder not shown. Notedly, between the recording unit 1 and the dryer 12 formed is the watching zone A. The heater 12a has a heat element 12c and reflection plate 12d, faces the recording face of the recording medium P, and dries it with interval E. To effectuate this dry process, the apparatus may be incorporated with a blower such as a fan not shown, and may thereby blow hot air to the recording medium P.

When the recording medium P moves to position P' according to separation thereof, the interval between the recording medium P and the heater 12a may become shorter. However, if the dryer 12 is turned so as to maintain swinging angle ø of the supporting plate 12b of the dryer 12 around the guide roller 4a as the center to be the same as angle ø between the original position and a shifted position of the recording medium P, the apparatus can maintain the interval E between the heater 12a and the recording medium P to be unchanged even after the recording medium P has shifted to the position P'. The angle ø is expressed by a formula: ø≈tan-1 (y2/y1), where distance between centers of the guide roller 4a and the separation roller 6a is y1 and where shifted distance of a cross line at which the separation roller 6a contacts the recording medium P is y2. To operate the drier 12 to turn so as to maintain the interval E, the controller 9 controls drive of the drier 12 according to the movement amount of the separation roller 6a.

The image forming apparatus, by turning control of the dryer 12, can dry the recording medium P uniformly and can record images with high quality. When the recording medium P is advanced, the recording face does not contact the heater 12a, so that the image recorded is not impaired. Notedly, although in this modification the dryer 12 is disposed on the recording face P1 side of the recording medium P, the dryer 12 may be disposed on the non-recording face P2 side of the recording medium P to obtain the same effects.

Third Embodiment

Figure 19:
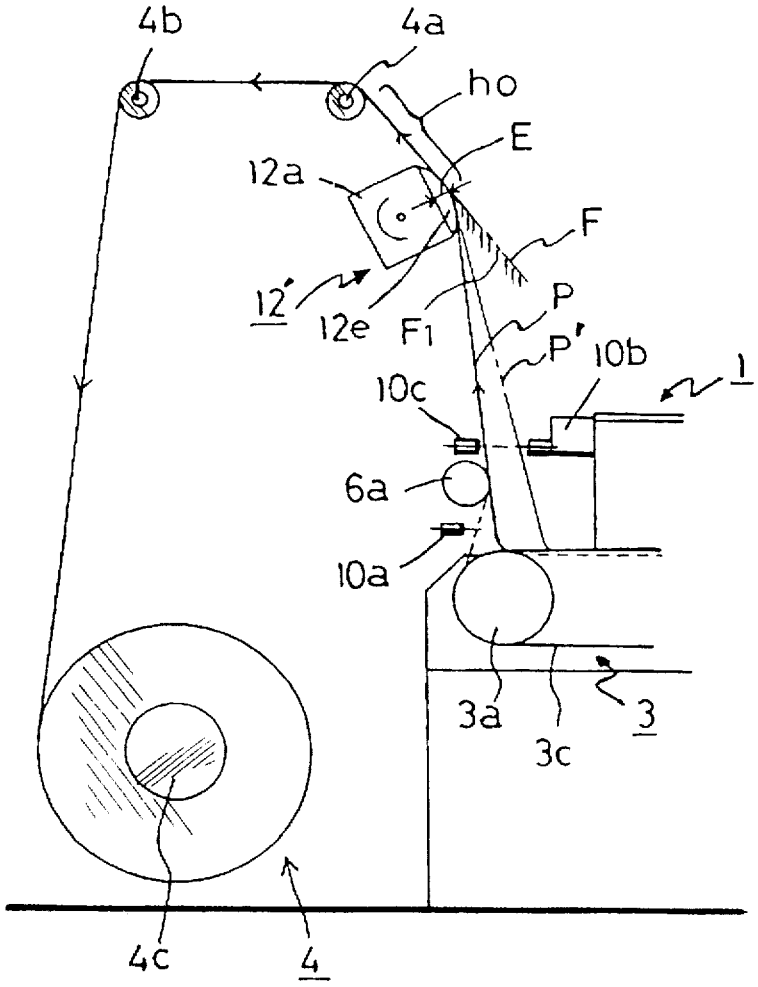
FIG. 19 is an illustration showing another drier of an image forming apparatus according to the invention.
Figure 20:
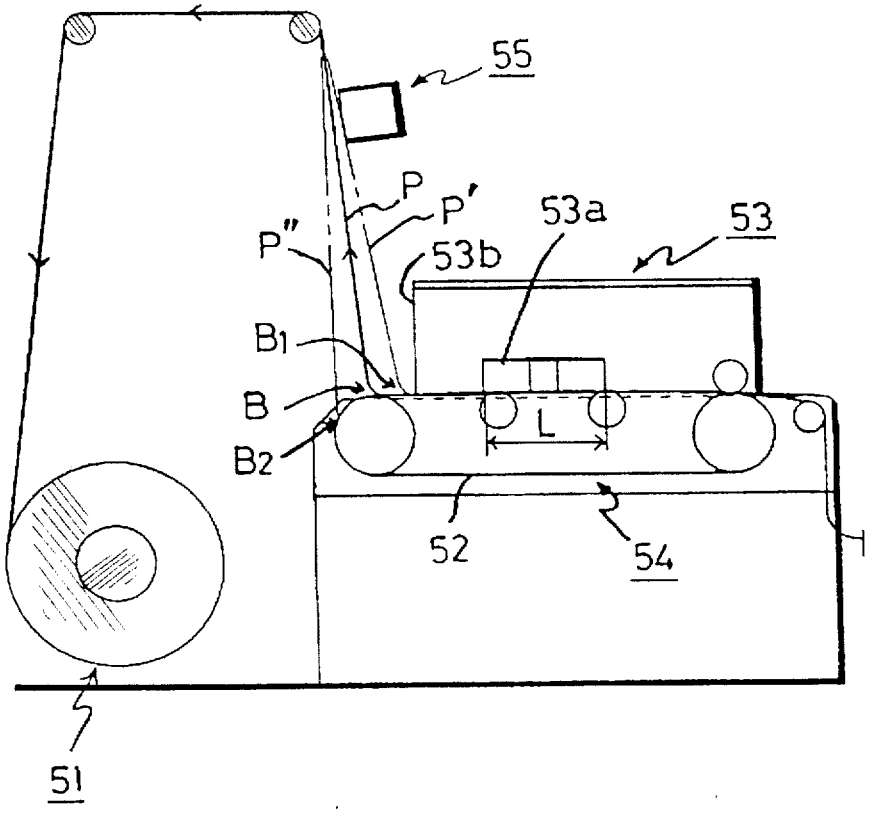
Fig. 20 (PRIOR ART)
FIG. 20 is an illustration showing constitution of a conventional image forming apparatus.
Figure 21:
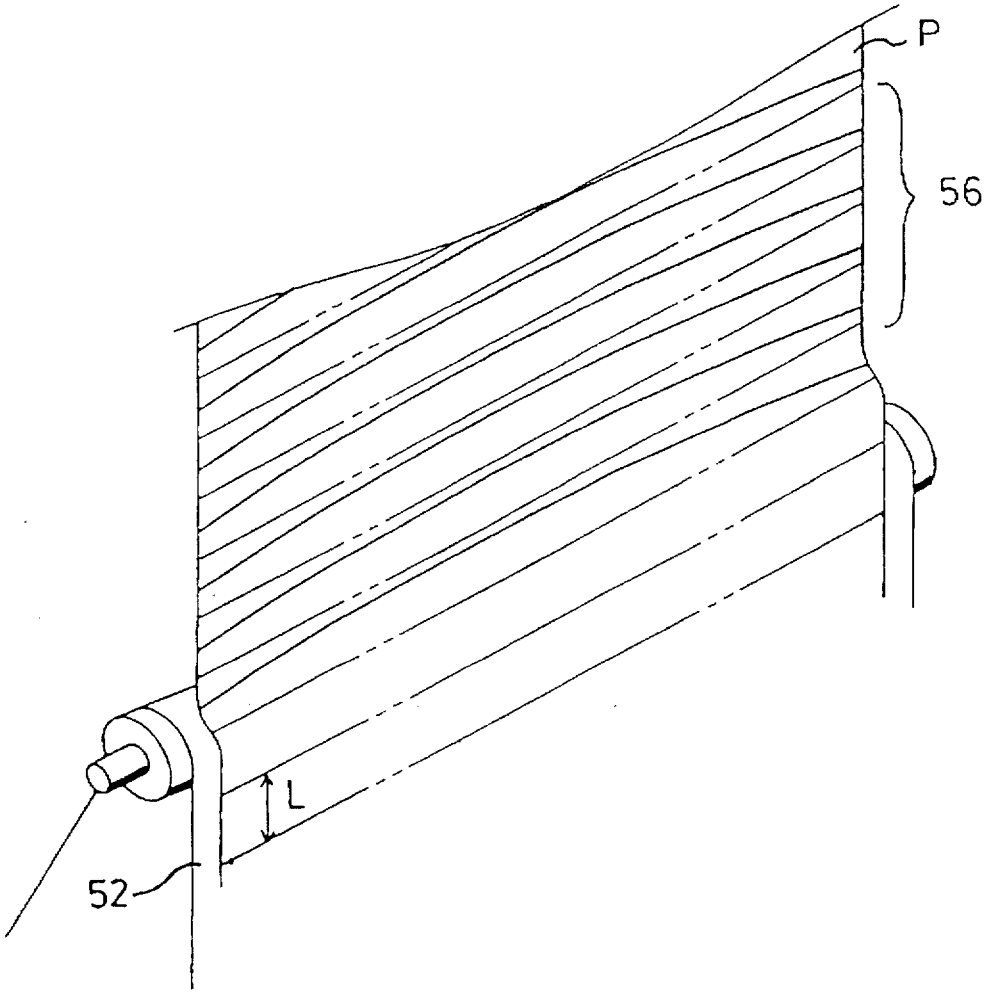
Fig. 21 (PRIOR ART)
FIG. 21 is an illustration showing problems in feeding operation of the image forming apparatus shown in FIG. 20.

Referring to FIG. 19, another embodiment of image forming apparatus is shown. Duplicated description is omitted, while the same member is given to the reference number as in the embodiment above.

FIG. 19 shows a modified apparatus having another dryer 12' different from one shown in FIGS. 17, 18. The dryer 12' has a guide plate 12*e* serving as guide means. The guide plate 12*e* is secured so as to face the feeding route of the recording medium P after separation. The dryer 12' constitutes together with the guide roller 4*a* plane h0, which is a plane in contact with the guide roller 4*a* and the guide plate 12*e*. If a plane in which the plane h0 is extended to and beyond the guide plate 12*e* is assumed as virtual plane F, the recording medium P is moved (P→P') to separate according to movement of the separation roller 6*a* always on a side of face F1 on which the virtual plane F contacts the guide plate 12*e*.

Accordingly, the recording medium P always forms the plane h0 even if the separation advancement occurs, so that the separation may not set the recording medium P apart from the guide plate 12*e*. The guide plate 12*e* is preferably formed in a shape with a convex curving face to contact with the recording medium P uniformly. The guide plate 12*e* is formed in a united body with the heater 12*a* so as to oppose with each other with the interval E, and the dryer 12' dries the recording medium P from the non-recording face P2 side thereof through the guide plate 12*e*.

According to the constitution above, the apparatus can dry the recording medium P while maintaining the interval (thermal distance) between the heater 12*a* and the recording medium P constant without controlling the dryer 12' to move according to separation advance or retreat of the recording medium P. Furthermore, the image forming apparatus can minimize operation stops thereof and can efficiently record images with high quality, by using distance sensors 10*a*, 10*b*, 10*b'*, 10*c*, 10*c'* as shown in FIGS. 8 to 15.

It is to be noted that although in the embodiments above the image forming means uses the ink jet recording method, it would be further preferable if constituted by energizing an electrothermal converter in accordance with recording signals and by discharging ink out of the ink outlet in accordance with bubble's growth and contraction occurring to the ink in use of film boiling occurring to the ink by means of thermal energy given from the electrothermal converter to record images.

This method can apply to any of so called On-Demand type and Continuous type. Specifically, in the case of the On-Demand type, it is effective because, by applying at least one drive signal which corresponds to the recording information and which provides rapid temperature increasing as exceeding nucleus boiling, thermal energy is made to occur at the electrothermal converter to produce film boiling on a thermal operation face of the recording head and, consequently, to form bubbles in the liquid corresponding to the drive signals one by one. Bubble's growth and contraction discharges liquid through the opening for discharging and forms at least one droplet. If the drive signal is formed in a pulse shape, excellent discharge of liquid can be achieved and it is more preferable, since bubble's growth and contraction is properly performed immediately.

This invention is further applicable to a full line type recording head having a length corresponding to the maximum width of the recording medium on which the recording apparatus can record. Such a recording head can be constituted by any of a combination of plural recording heads which satisfy the length and a single recording head unitedly formed.

In addition, among the recording heads of the serial type described above, a recording head fixed to the carriage, a replaceable recording head of a chip type that allows electrical connections with the apparatus body and ink supply from the apparatus body by being attached to the carriage, a recording head of a cartridge type in which an ink tank is arranged in a united body with the recording head itself, or the like can be used.

It is preferable to add such restoring means for recording heads and preliminary supplemental means, given as constitution of the recording apparatus of the invention, because they can make the effects of the invention more stable. If they are exemplified specifically, capping means against the recording heads, cleaning means, pressure or absorbing means, preheating means made of heating elements of an electrothermal converter or else or their combination, and performing a preliminary discharge mode for discharging as different from recording are effective for stable recording.

As for kinds and number of the recording heads mounted on the carriage, in addition to one in which only one recording head is arranged corresponding to a monochrome ink, for example, they can be provided in a plural number corresponding to the plural inks having different color and density from one another. That is, for example, it is applicable, as a recording mode of the recording apparatus, not for a recording mode only for main color such as black, but for an apparatus equipped with at least either multicolor made of different colors or full color made of mixed colors, though a recording head unitedly constituted, a combination of plural pieces of heads or whatever may be used.

Furthermore, although in the embodiment described above ink is described as liquid, an ink solidified at room temperature or below and softened or liquefied at room temperature, or one where an ink is liquefied when a recording signal for use is applied because in the ink jet recording method it is general to control temperature so that ink's viscosity is in a stable range of discharge by adjusting temperature of the ink itself in a range from 30° C. or above to 70° C. or below, can be used. In addition, it is also applicable for one in which the ink is liquefied, in any event, by application of thermal energy according to the recording signals either by preventing temperature from increasing due to thermal energy by positive use as energy for phase change from solid state to liquid state or by using ink that solidified when left as it is for the purpose of prevention of ink's evaporation, so that the liquid ink is discharged, and for the case using an ink having nature that nothing except thermal energy makes it liquefy such that when it reaches the recording sheet the ink already begin to solidify.

Moreover, a form of the ink jet recording apparatus described above may be, in addition to one used as an image output terminal for an information processing apparatus such as a computer, a photocopier in combination with a reader or the like, one taking a form of a facsimile apparatus having transmission and receiving functions, and the like.

As described above, the image forming apparatus according to the invention can separate the recording medium from the conveying belt without stops even while the recording medium is fed intermittently by the feeding unit, so that the apparatus can continuously separate the recording medium during the period for image recording, or during the stop period of the intermittent feeding, and during the period for ceasing recording, or during the feeding period of the intermittent feeding. Consequently, the image forming apparatus can smoothly separate the recording medium from the feeding unit without forming separation marks in stripe patterns, and therefore, can record images with high quality.

The image forming apparatus can maintain the separation line between the recording medium and the feeding unit in a certain range; if the separation position reaches the limitation, the apparatus can control the respective drive sources to prevent the recording medium from contacting other members and from jamming; and if the separation position goes beyond the limitation, the apparatus can stop its operation. By such operations, the apparatus can suppress extraordinary separation automatically and can efficiently record images with high quality and without reducing the operation rate thereof.

By drying the recording medium with a constant interval between the recording medium and the dryer on a plane formed by the guide member, the apparatus can maintain the thermal distance between the dryer and the recording medium constant, regardless of separation advance or retreat of the recording medium, and can efficiently record images with high quality.

It is to be noted that although the most preferred embodiment according to the invention is described, persons skilled in the art may consider other constitution or modifications. Therefore, this invention is not restricted to the embodiments above, and other variations are covered as far as within the scope of the following claims.

What is claimed is:

1. An image forming apparatus comprising:

feeding means for feeding an attached recording medium in a predetermined feeding direction;

image forming means for receiving the recording medium from said feeding means, and for forming images on the received recording medium; and separating means, located on a downstream side of said image forming means, for separating the attached recording medium from the feeding means in a direction angled from the predetermined feeding direction of the feeding means, said separating means moving to push the recording medium from a non-recording face side thereof to a recording face side thereof while the recording medium is stopped during intermittent feeding, to cause even separation of the recording medium from said feeding means.

2. The image forming apparatus as set forth in claim 1, wherein the separating means includes a roller rotatably supported by a supporting arm, and separates the recording medium from the feeding means by shifting the roller in a direction intersecting the feeding direction of the recording medium.

3. The image forming apparatus as set forth in claim 2, wherein the separating means extends and contracts the supporting arm to shift the roller.

4. The image forming apparatus as set forth in claim 2, wherein the separating means rotates the supporting arm to shift the roller.

5. The image forming apparatus as set forth in claim 2, wherein the separating means is formed with multiple holes located on a round surface of the roller, and further comprising a suction pump to suck the recording medium to the roller holes.

6. The image forming apparatus as set forth in claim 1, and further comprising detecting means placed on an upstream side of the feeding means for judging as to whether separation position at which the recording medium separates from the feeding means is within a predetermined zone, wherein at least one drive of the winding means, feeding means and the separating means is controlled in accordance with the detected result of the detecting means.

7. The image forming apparatus as set forth in claim 6, wherein the detecting means is at least not in contact with the recording face of the recording medium and is disposed with a sensor detecting distance between the recording medium and itself.

8. The image forming apparatus as set forth in claim 1, and further comprising a guide member arranged at a feeding route to the feeding means of the recording medium for guiding the recording medium always in contact with the non-recording face of the recording medium and thereby forming a constant plane, and drying means disposed facing the constant plane for drying the recording medium.

9. The image forming apparatus as set forth in claim 8, wherein the drying means includes a heater that swings, according to positional shifts of the recording medium by operation of the separating means, while the heater maintains a predetermined interval between itself and the recording medium.

10. The image forming apparatus as set forth in claim 8, wherein the drying means includes a heater and a guide plate always contacting the non-recording face side of the recording medium, and wherein the heater is a fixed distance away from the guide plate.

11. The image forming apparatus as set forth in claim 1, wherein an angle with which the recording medium separates from the feeding means is in a range from 70 to 120 degrees.

12. The image forming apparatus as set forth in claim 1, wherein the feeding means comprises a belt conveyer in which a belt is wound around plural rollers, and further comprising cleaning means for cleaning the belt at a zone which is outside a zone at which the belt conveys the recording medium.

13. The image forming apparatus as set forth in claim 12, wherein, where: the belt of the feeding means is assumed to have width W3; the image forming means is assumed to form images with the maximum width W2; and the recording medium is assumed to have width W1, the widths satisfy the relation of W3>W2>W1.

14. The image forming apparatus as set forth in any one of claims 1 to 13, wherein the image forming means uses an ink jet method in which ink is discharged for recording in accordance with signals based on image information.

15. The image forming apparatus as set forth in claim 14, wherein the image forming means includes an electric-thermal converter for generating thermal energy for ink discharge.

16. The image forming apparatus as set forth in claim 1, wherein the image forming means discharges ink out of one or multiple ink outlets caused by film boiling occurring to the ink upon application of thermal energy.

17. An image forming apparatus comprising:

feeding means for feeding a sheet in a predetermined direction by attaching a part of the sheet to said feeding means, the feeding means intermittently feeding the sheet by repeating (i) a stop period for keeping the sheet stationary and (ii) a feeding period for moving the sheet by a predetermined length;

image forming means for receiving the sheet from the feeding means, and for forming images on the sheet fed by the feeding means during the stop period of the feeding means; and separating means, located on a downstream side of the feeding means, for separating the sheet from the feeding means, said separating means moving to push a non-image side of said sheet to evenly separate said sheet from said feeding means.

18. The image forming apparatus as set forth in claim 17, wherein the separating means includes a roller rotatably supported by a supporting arm, and separates the sheet from the feeding means by shifting the roller in a direction intersecting the feeding direction of the sheet.

19. The image forming apparatus as set forth in claim 18, wherein the separating means extends and contracts the supporting arm to shift the roller.

20. The image forming apparatus as set forth in claim 18, wherein the separating means rotates the supporting arm to shift the roller.

21. The image forming apparatus as set forth in claim 17, and further comprising detecting means for judging as to whether a separation position at which the sheet separates from the feeding means is within a predetermined zone, wherein movement of the separating means is controlled in accordance with the a detection result of the detecting means.

22. The image forming apparatus as set forth in claim 17, and further comprising a guide member arranged at a feeding route of the feeding means for guiding the sheet always in contact with the non-recording face of the sheet and thereby forming a constant plane, and drying means disposed facing the plane for drying the sheet, and wherein shifts of the sheet on the downstream side of the feeding means are performed with the feeding means.

23. The image forming apparatus as set forth in claim 17, wherein the feeding means comprises a belt conveyor in which a belt is wound around plural rollers, and further comprising cleaning means for cleaning the belt at a zone which is outside a zone at which the belt conveys the sheet.

24. The image forming apparatus as set forth in claim 17, wherein the image forming means includes an electric-thermal converter for generating thermal energy for ink discharge.

25. The image forming apparatus as set forth in claim 24, wherein the image forming means discharges ink out of one or multiple ink outlets caused by film boiling occurring to the ink upon application of thermal energy.

26.The image forming apparatus set forth in any one of claims 17 to 25, wherein the sheet includes cloth.

* * * * *